US007617969B2

(12) United States Patent
Oliveira

(10) Patent No.: US 7,617,969 B2
(45) Date of Patent: Nov. 17, 2009

(54) CARTON CAPABLE OF CARRYING TAKE-OUT FOOD AND BEVERAGES

(75) Inventor: Steven Manuel Oliveira, Nashua, NH (US)

(73) Assignee: Graphic Packaging International, Inc., Marietta, GA (US)

( * ) Notice: Subject to any disclaimer, the term of this patent is extended or adjusted under 35 U.S.C. 154(b) by 518 days.

(21) Appl. No.: 11/170,961

(22) Filed: Jun. 30, 2005

(65) Prior Publication Data

US 2007/0000980 A1 Jan. 4, 2007

(51) Int. Cl.
*B65D 5/46* (2006.01)
*B65D 25/04* (2006.01)
*B65D 75/00* (2006.01)

(52) U.S. Cl. ..... 229/117.15; 229/120.15; 206/145; 206/158

(58) Field of Classification Search ..... 229/120.15, 229/117.15, 904, 906; 206/158, 145, 45.26, 206/193, 197, 196, 194
See application file for complete search history.

(56) References Cited

U.S. PATENT DOCUMENTS

D115,651 S 7/1939 Ford et al.
D120,673 S 5/1940 Jung
2,348,378 A 5/1944 Goodyear
2,586,301 A 2/1952 Castle
2,794,585 A * 6/1957 Wagner ..... 206/561
3,013,710 A 12/1961 Kronson et al.
3,257,027 A 6/1966 Weiss
3,640,380 A 2/1972 Huffman
D242,901 S 1/1977 Lohrbach
4,007,869 A 2/1977 Stolkin et al.
4,238,069 A * 12/1980 Morris, Jr. ..... 229/117.15
4,397,393 A * 8/1983 Pergande et al. ..... 206/549
4,530,459 A 7/1985 Maroszek (Continued)

FOREIGN PATENT DOCUMENTS

EP 0 639 504 A1 2/1995

(Continued)

OTHER PUBLICATIONS

U.S. Appl. No. 29/233,311, filed Jun. 30, 2005; In re: Steven Manuel Oliveira, entitled *Carton*.

*Primary Examiner*—Nathan J Newhouse
*Assistant Examiner*—Christopher Demeree
(74) *Attorney, Agent, or Firm*—Womble Carlyle Sandridge & Rice, PLLC

(57) ABSTRACT

A carton has side panels extending upwardly from respective edges of the carton's bottom. Upright edges of the side panels are respectively connected to one another to define upright corners of the carton. At least a first opening to the carton's interior extends across a first of the upright corners. At least one partition has opposite ends that are respectively pivotably connected to the side panels that define the first upright corner, so that the partition can be pivoted between a deployed configuration and an undeployed configuration. The partition at least partially closes the first opening in the undeployed configuration. The partition extends into the carton's interior and at least partially around a compartment during the deployed configuration, whereby the partition at least partially defines the compartment during the deployed configuration. At least a second opening extends through the partition.

63 Claims, 20 Drawing Sheets

U.S. PATENT DOCUMENTS

| | | | | |
|---|---|---|---|---|
| 4,601,390 | A * | 7/1986 | Rosenthal et al. | 206/175 |
| D319,388 | S | 8/1991 | McIntosh, Jr. et al. | |
| 5,299,734 | A * | 4/1994 | Lane | 229/120.32 |
| 5,400,901 | A | 3/1995 | Harrelson | |
| 5,501,335 | A * | 3/1996 | Harris | 206/427 |
| 5,524,814 | A | 6/1996 | Davis | |
| D373,079 | S | 8/1996 | Fahlen | |
| 5,551,556 | A | 9/1996 | Sutherland | |
| 5,595,291 | A | 1/1997 | Negelen | |
| D386,680 | S | 11/1997 | Johnson | |
| 5,950,912 | A * | 9/1999 | Economopoulos | 229/120.32 |
| 6,439,452 | B1 * | 8/2002 | Tsao | 229/120.15 |
| 6,530,516 | B1 | 3/2003 | Ritter | |
| 2003/0213705 | A1 | 11/2003 | Woog | |
| 2006/0091190 | A1 | 5/2006 | Nikolai | |

FOREIGN PATENT DOCUMENTS

| | | |
|---|---|---|
| GB | 889 718 | 2/1962 |
| SE | 140 388 | 5/1953 |

* cited by examiner

CARTON CAPABLE OF CARRYING TAKE-OUT FOOD AND BEVERAGES

BACKGROUND OF THE INVENTION

Cartons that are capable of carrying take-out food and beverages are well known. For example, see U.S. Pat. Nos. 2,586,301; 3,013,710; 3,640,380 and 5,524,184.

There is always a desire for cartons that provide a new balance of properties.

BRIEF SUMMARY OF SOME ASPECTS OF THE INVENTION

One aspect of the present invention is the provision of a carton having side panels extending upwardly from respective edges of the carton's bottom, with side edges of the side panels being respectively connected to one another to define upright corners of the carton. At least one of the upright corners can include a tab, which can be upwardly extending. At least one band extends across the corner and at least partially around the tab. The band has opposite ends that are respectively pivotably connected to the side panels that define the corner that includes the tab. The tab and band can be defined by tear lines.

In accordance with one aspect of the present invention, the band can function as a partition that is pivotable between a deployed configuration and an undeployed configuration. The band-like partition extends into the carton's interior and at least partially defines a compartment (e.g., a cup holder) during the deployed configuration. An article, such as a beverage container, can be placed in the compartment, and the tab can advantageously help to hold the article in the compartment.

According to one aspect of the present invention, an opening extends through the band-like partition. In accordance with this aspect, the carton can be erected from a blank. The band-like partition can be struck from the tab so that the opening, which extends through the band-like partition, at least generally corresponds in shape to the tab.

Further to one aspect of the present invention, the tab extends along a fold line, and the band extends across the fold line. The fold line can bifurcate each of the tab and the band.

Other aspects and advantages of the present invention will become apparent from the following.

BRIEF DESCRIPTION OF THE DRAWINGS

Having described some aspects of the invention in general terms, reference will now be made to the accompanying drawings, which are not necessarily drawn to scale, and wherein:

FIG. 1 is also illustrative of a rear, left perspective view of the carton with its top panels in the open configuration, in accordance with an exemplary embodiment of the present invention;

FIG. 8 is also generally illustrative of a rear, left perspective view of the carton with its top panels in the gable-defining closed configuration, in accordance with the exemplary embodiment of the present invention;

FIG. 12 is also generally illustrative of a rear, left perspective view of the carton with its top panels in the flat closed configuration, in accordance with the exemplary embodiment of the present invention;

FIG. 15 is a front, right perspective view of the carton containing articles, namely drink bottles, and with its top panels in the flat closed configuration, wherein FIG. 15 is also generally illustrative of a rear, left perspective view of the carton containing articles and with its top panels in the flat closed configuration, in accordance with the exemplary embodiment of the present invention;

DETAILED DESCRIPTION

Figure 1:
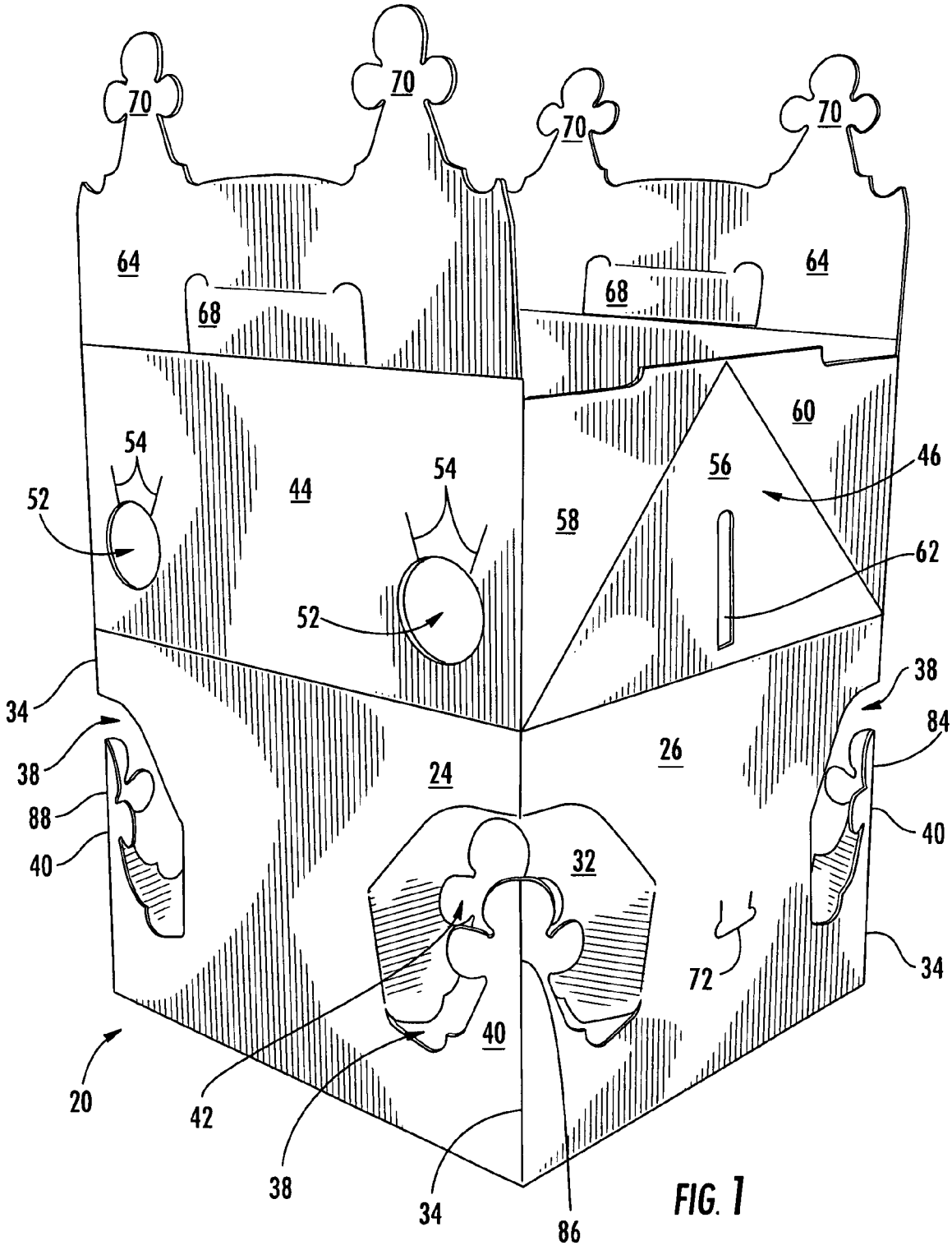
FIG. 1 is a front, right perspective view of a carton with its top panels in an open configuration.
Figure 2:
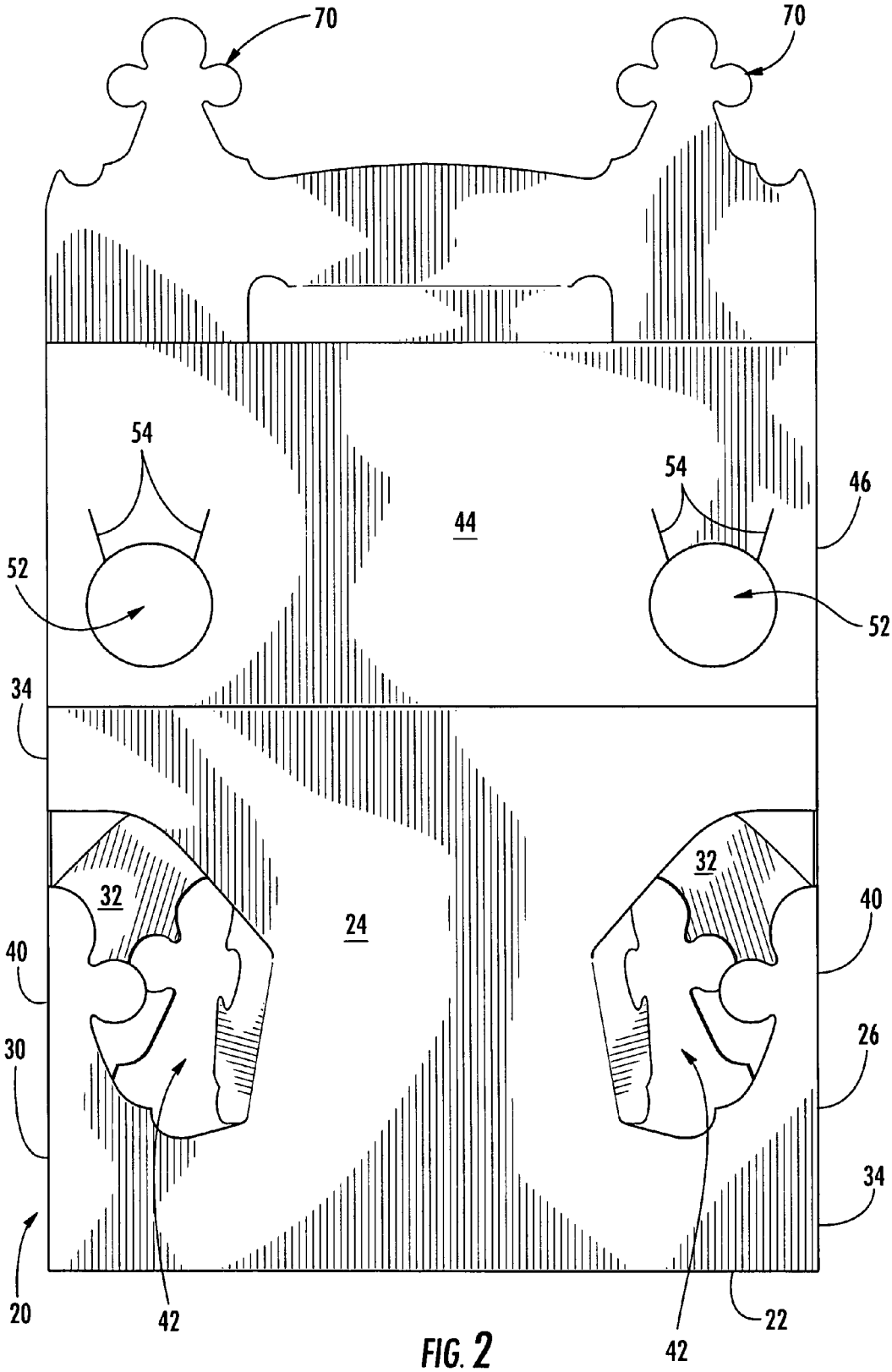
FIG. 2 is a front elevation view of the carton with its top panels in the open configuration.

Referring now in greater detail to the drawings, in which like numerals refer to like parts throughout the several views, an exemplary embodiment of the present invention is described in the following.

A carton of the exemplary embodiment of the present invention as designated by the numeral 20, and the carton is capable of carrying one or more articles that can be, for example and without limitation, take-out food and/or beverages. As best understood with reference to FIGS. 6 and 7, the carton 20 includes a bottom 22. Referring to FIGS. 1-5, the carton 20 further includes a front side panel 24 extending upwardly from the front edge of the bottom 22, a right side panel 26 extending upwardly from the right edge of the bottom 22, a rear side panel 28 extending upwardly from the rear edge of the bottom 22, and a left side panel 30 extending upwardly from the left edge of the bottom 22.

Four band-like partitions 32 are respectively associated with the four upright corners 34 respectively defined between upright edges of the side panels 24, 26, 28, 30. For each of the partitions 32, it has opposite ends that are respectively pivotally connected to the respective side panels that define the upright corner 34 that contains the partition. As a result, each partition 32 can be pivoted between a deployed configuration and an undeployed configuration. As can be generally understood with reference to FIGS. 16-20, in the undeployed configuration, each partition 32 is flush with the respective side panels that define the upright corner 34 in which the partition is positioned.

Figure 4:
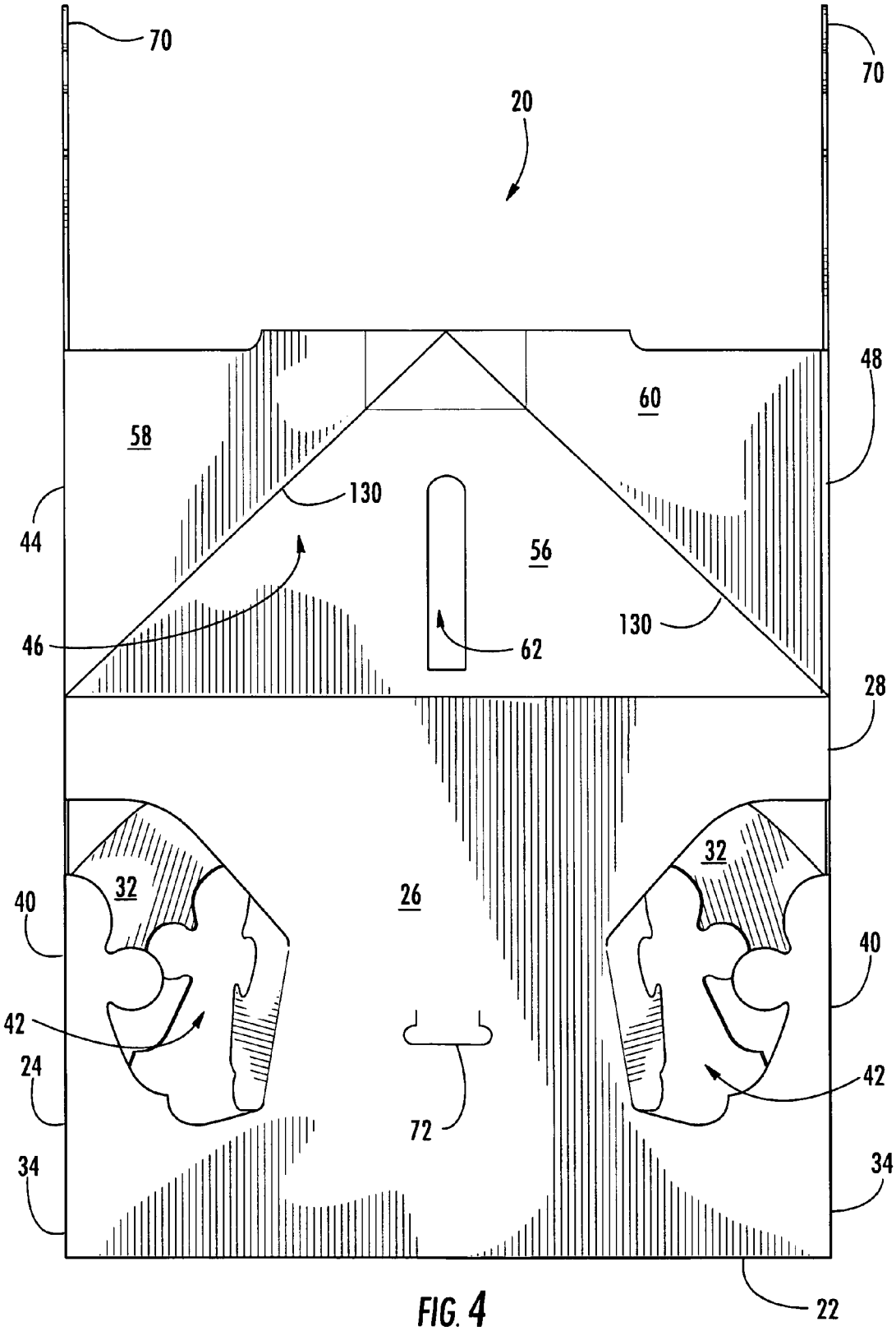
FIG. 4 is a right elevation view of the carton with its top panels in the open configuration.
Figure 5:
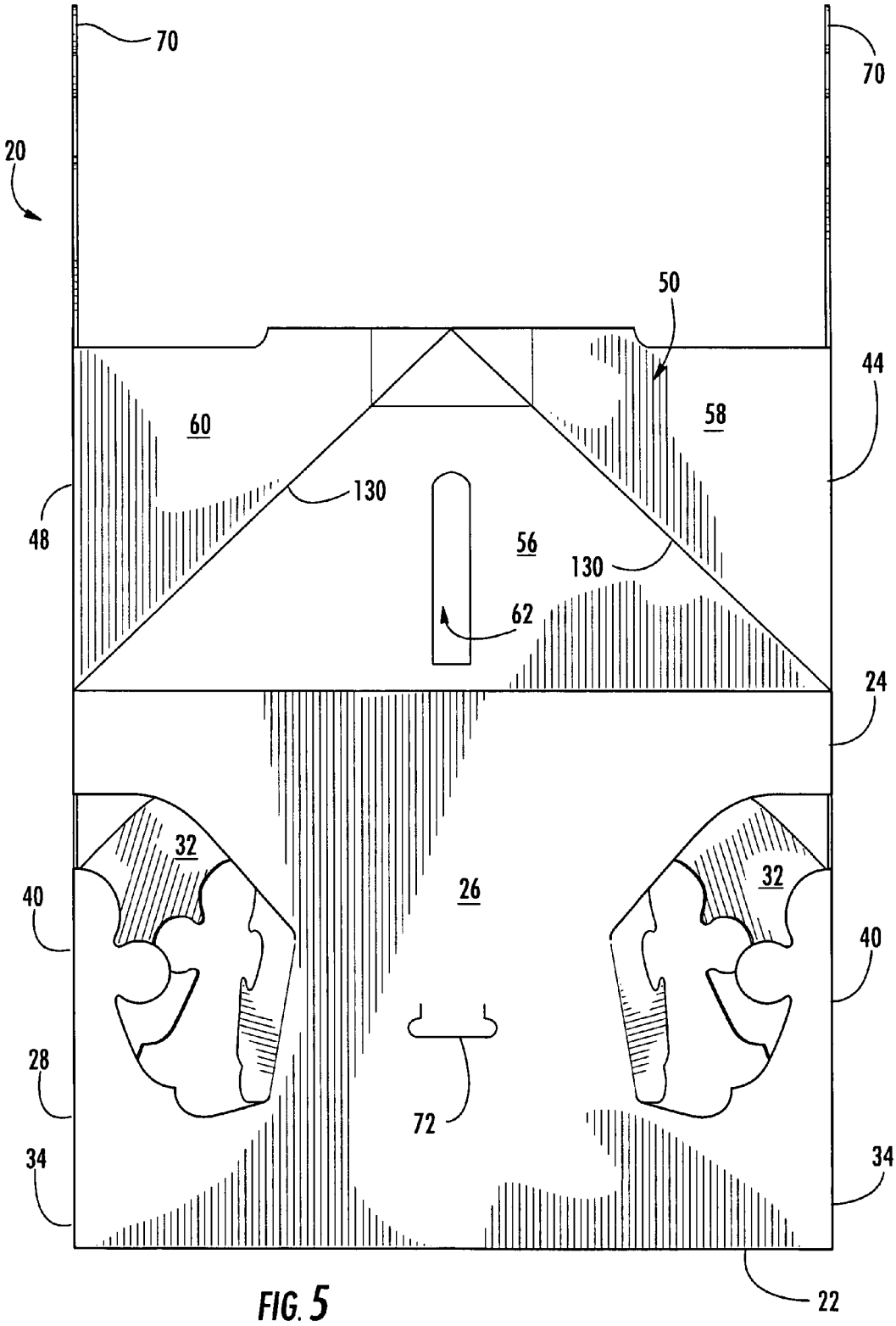
FIG. 5 is a left elevation view of the carton with its top panels in the open configuration.
Figure 6:
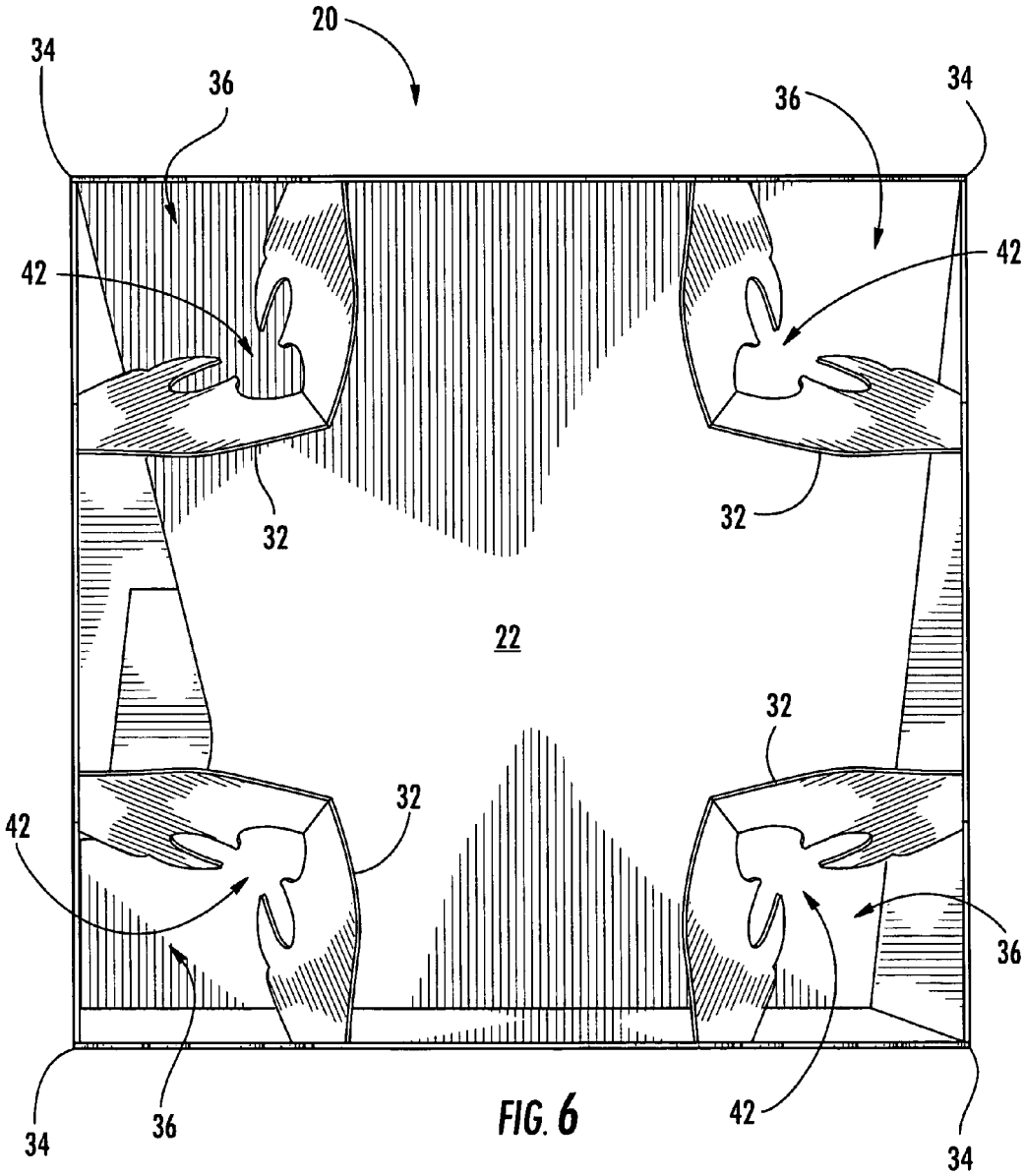
FIG. 6 is a top plan view of the carton with its top panels in the open configuration.
Figure 7:
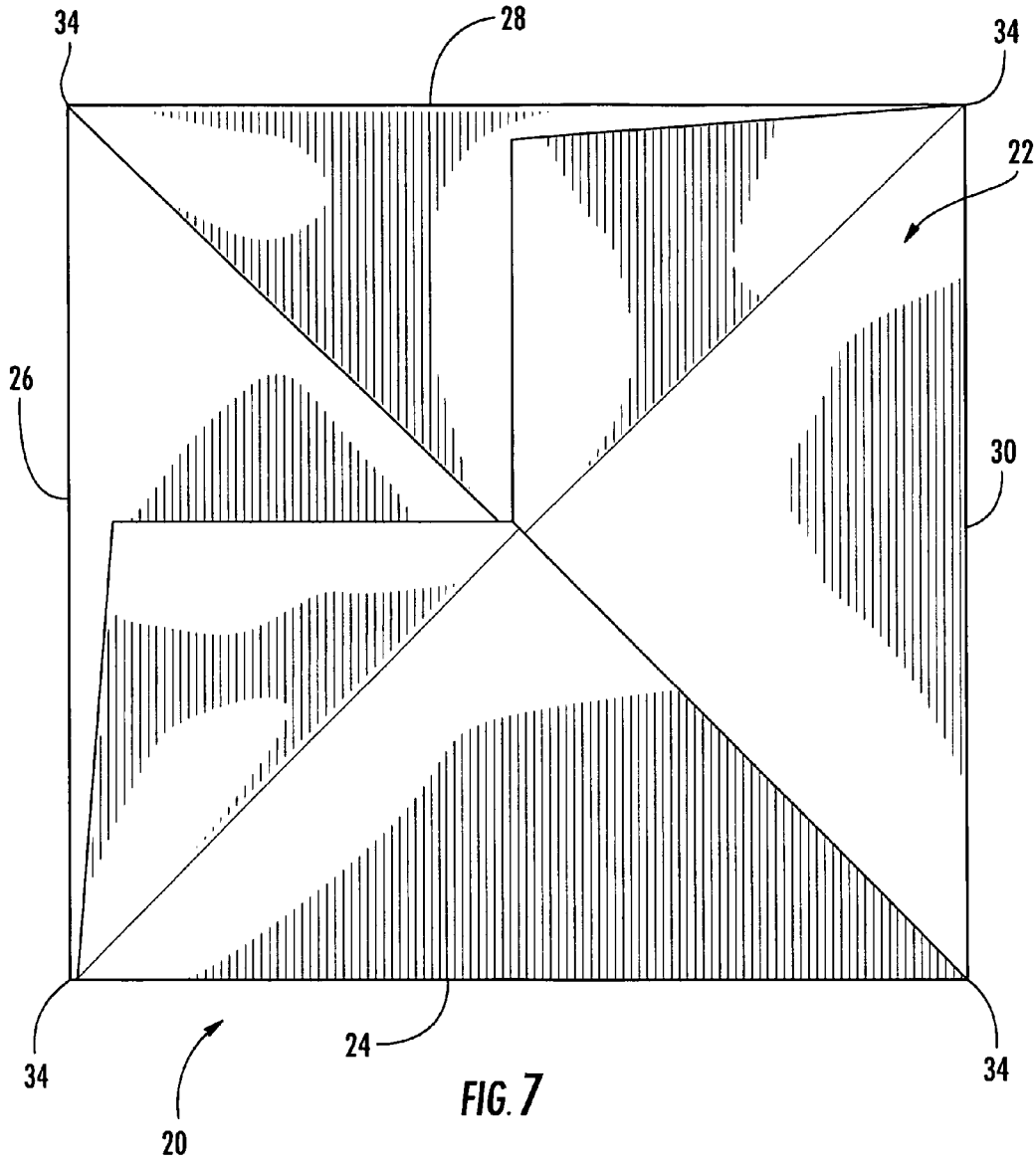
FIG. 7 is illustrative of a bottom plan view of the carton with its top panels in either the open configuration or a gable-defining closed configuration, in accordance with the exemplary embodiment of the present invention.

As best understood for example with reference to FIGS. 1-6, in the deployed configuration, the partitions 32 protrude into the carton's interior to at least partially define corner compartments 36 (FIG. 6). The corner compartments 36 can be generally referred to, for example and not for purposes of narrowing the scope of the present invention, as cup holders, or the like. Each of the corner compartments 36 can hold one or more articles (e.g., drinks), and one or more other articles (e.g., sandwiches and side items) can be placed in the portion of the carton's interior that is not in the form of corner compartments 36. As best understood with reference to FIGS. 1-5, exterior compartment openings 38 are respectively associated with the corner compartments 36 (FIG. 6), at least during the deployed configuration. The exterior compartment openings 38 are open through each of the side panels 24, 26, 28, 30, such as for providing visual access to the corner compartments 36 and/or articles positioned in the corner compartments.

Each of the upright corners 34 includes a tab 40 that at least partially defines, and that can be characterized as protruding into, the exterior compartment opening 38 that is defined in the upright corner. In addition and as best understood with reference to FIG. 6, each of the partitions 32 defines a partition opening 42 that extend through the partition. In accordance with the exemplary embodiment of the present invention, each of the partition openings 42 corresponds in shape to the tab 40 associated therewith, and all of the tabs 40 are shaped substantially identically, as will be discussed in greater detail below.

In accordance with the exemplary embodiment of the present invention, edges of front, right, rear and left top panels 44, 46, 48, 50 are respectively connected to the upper edges of the side panels 24, 26, 28, 30. As best understood with reference to FIGS. 1-3, each of the front and rear top panels 44, 48 includes a pair of top holes 52. For each of the top holes 52, a pair of tear lines 54 can extend divergently away from the top hole to define a tab. Optionally, for each of the pair of tear lines 54, a fold line can extend between the ends of the pair of tear lines that are distant from the associated top hole 52. As best understood with reference to FIG. 15, articles (e.g., bottles 74) contained within the corner compartments 36 can respectively protrude through the top holes 52. The tabs defined by tearing along the tear lines 54 can be used to enlarge the top holes 52 if needed or desired.

As best understood with reference to FIGS. 1, 4 and 5, each of the right and left top panels 46, 50 includes fold lines 130 that respectively divide the right and left top panels so that they respectively include central, forward and rearward triangular portions 56, 58, 60. Each of the central triangular portions 56 optionally includes an elongate hole 62 that extends therethrough.

Figure 8:
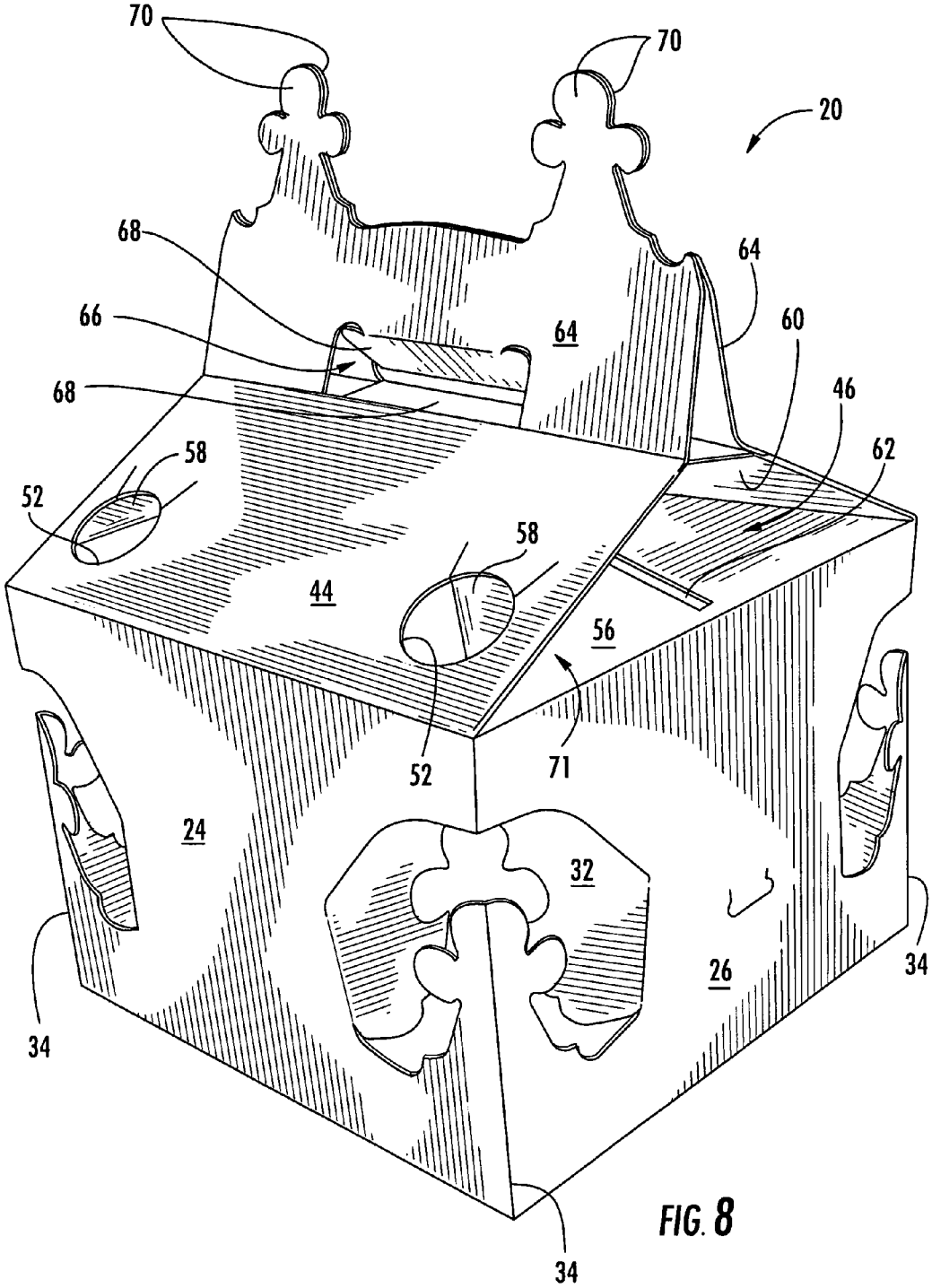
FIG. 8 is a front, right perspective view of the carton with its top panels in the gable-defining closed configuration.

As best understood with reference to FIGS. 1 and 8, separate handles 64 are respectively connected to upper edges of the front and rear top panels 44, 48. Each of the handles 64 includes a handle opening 66 (e.g., for receiving a user's fingers) that is optionally equipped with a handle flap 68. In addition, a pair of tabs 70 extend upwardly from each of the handles 64.

In accordance with the exemplary embodiment of the present invention, each of the tabs 40, 70 is in the shape of a symbol. Suitable symbols include, but are not limited to, three-leafed clover-like symbols, crown-like symbols, and the like. More specifically and in accordance with the exemplary embodiment of the present invention, each of the tabs 40, 70 includes a plurality of lobes. Even more specifically, each of the tabs 40, 70 includes a base and three lobes protruding from an end of the base. As illustrated in the drawings, for each of the tabs 40, 70, two of the lobes respectively protrude outwardly from opposite sides of the base, and another of the lobes protrudes outwardly from the end of the base.

Also in accordance with the exemplary embodiment of the present invention, each of the partition openings 42 correspond in shape to the tabs 40. This similarity in shape can result, for example, because the partitions 32 are struck from tabs 40 by tearing along tear lines, as will be discussed in greater detail below. A wide variety of differently shaped partitions 32, tabs 40, 70 and partition openings 42 are within the scope of the present invention.

With the top panels 44, 46, 48, 50 in the open configuration illustrated in FIGS. 1-6, upper edges of the side panels 24, 26, 28, 30 define an upper opening to the carton's interior. FIGS. 8-11 illustrate the top panels 44, 46, 48, 50 in a gable-defining closed configuration, in which the top panels at least partially close the upper opening to the carton's interior that is defined by upper edges of the side panels 24, 26, 28, 30.

An acceptable method for converting the top panels 44, 46, 48, 50 from the open configuration illustrated in FIGS. 1-6 to the gable-defining closed configuration illustrated in FIGS. 8-11 will be described in the following, in accordance with the exemplary embodiment of the present invention. With the right and left top panels 46, 50 configured as illustrated in FIGS. 1, 4 and 5, the central triangular portions 56 are simultaneously folded inwardly. As the central triangular portions 56 are folded inwardly, the front and rear top panels 44, 48 are caused to fold inwardly. As a result, upward facing sides of the forward triangular portions 58 are in opposing face-to-face configuration with the interior surface of the front top panel 44, and the downward facing surfaces of the forward triangular portions 58 are respectively in opposing face-to-face configuration with respect to the central triangular portions 56. Likewise, upward facing sides of the rearward triangular portions 60 are in opposing face-to-face configuration with the interior surface of the rear top panel 48, and the downward facing surfaces of the rearward triangular portions 60 are respectively in opposing face-to-face configuration with respect to the central triangular portions 56.

Figure 9:
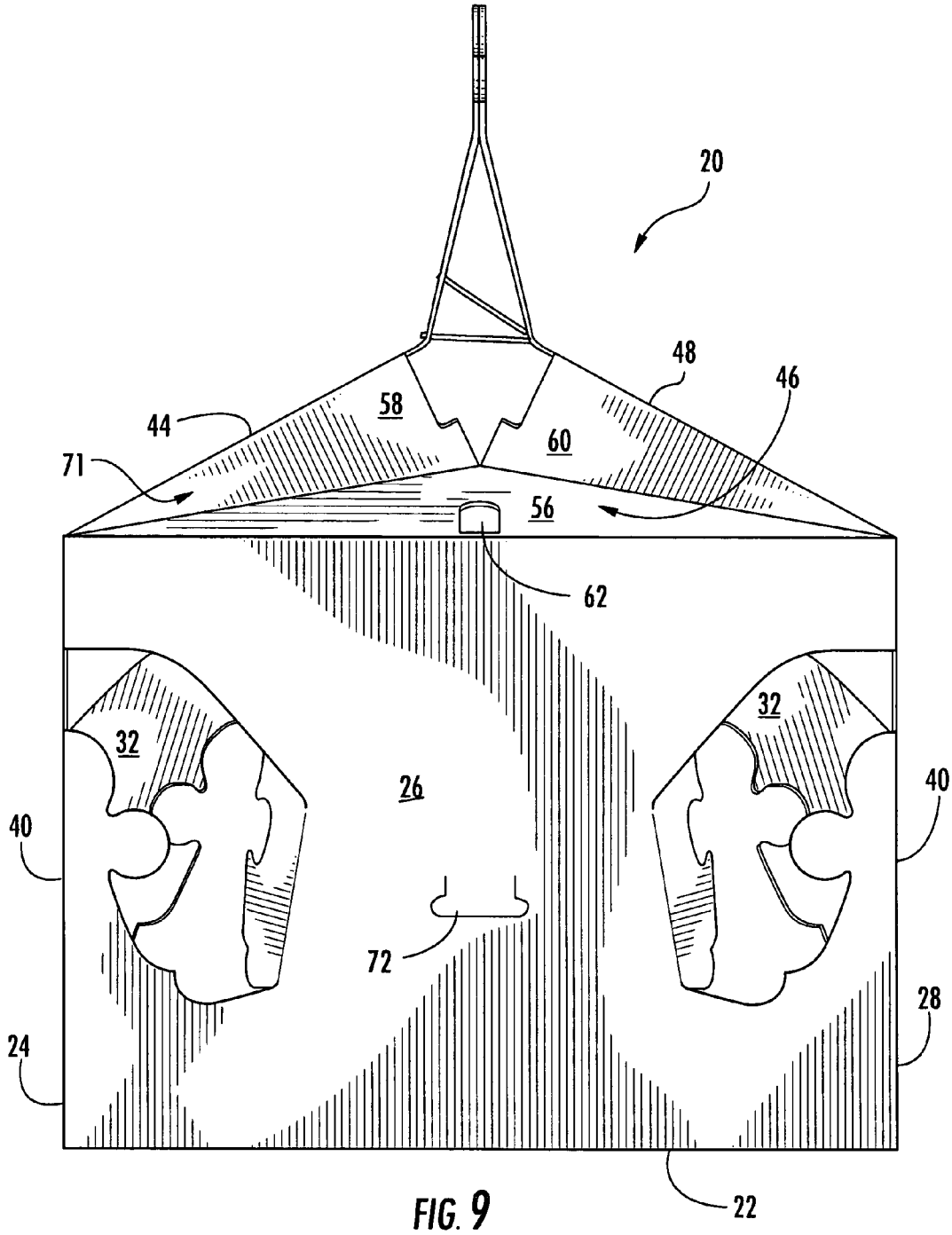
FIG. 9 is a right elevation view of the carton with its top panels in the gable-defining closed configuration.
Figure 10:
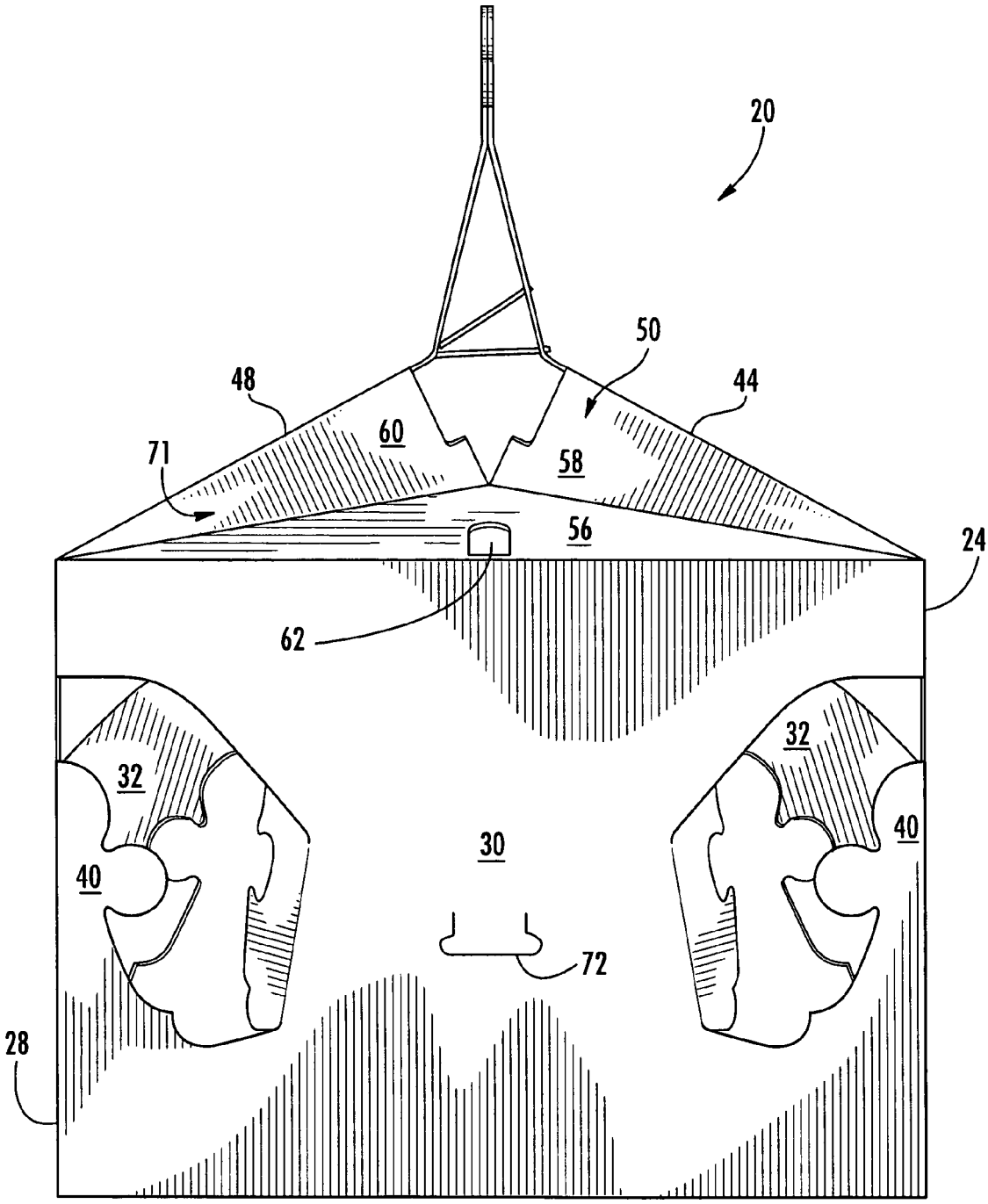
FIG. 10 is a left elevation view of the carton with its top panels in the gable-defining closed configuration.
Figure 11:
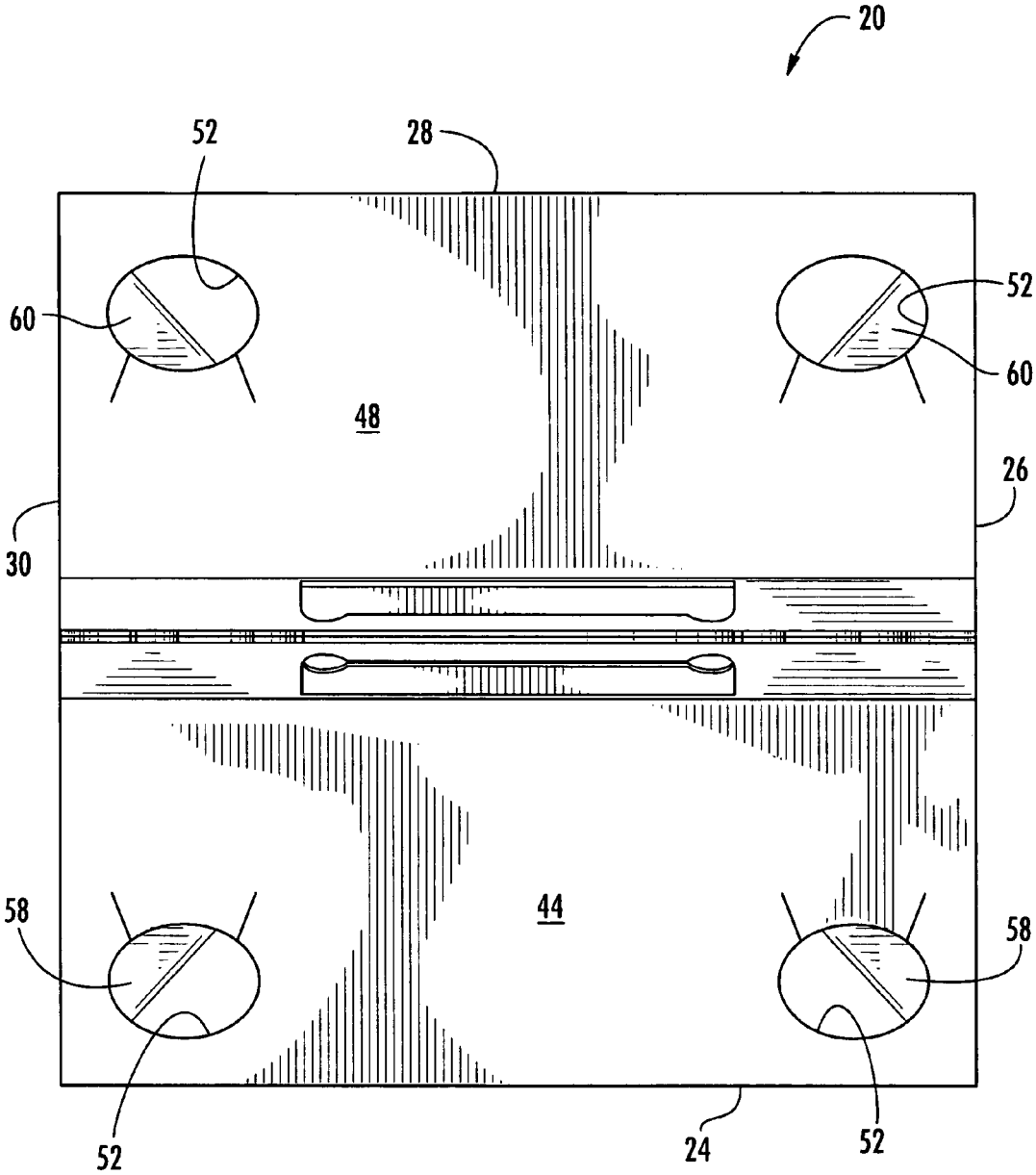
FIG. 11 is a top plan view of the carton with its top panels in the gable-defining closed configuration.

As best understood with reference to FIGS. 8-10, a gable area 71 is defined at each of the right and left sides of the carton 20 while the top panels 44, 46, 48, 50 are in the gable-defining closed configuration. For each of the gable areas 71, it is generally defined between an upwardly facing surface of the central triangular portion 56 and downwardly facing surfaces of the forward and rearward triangular portions 58, 60.

Figure 3:
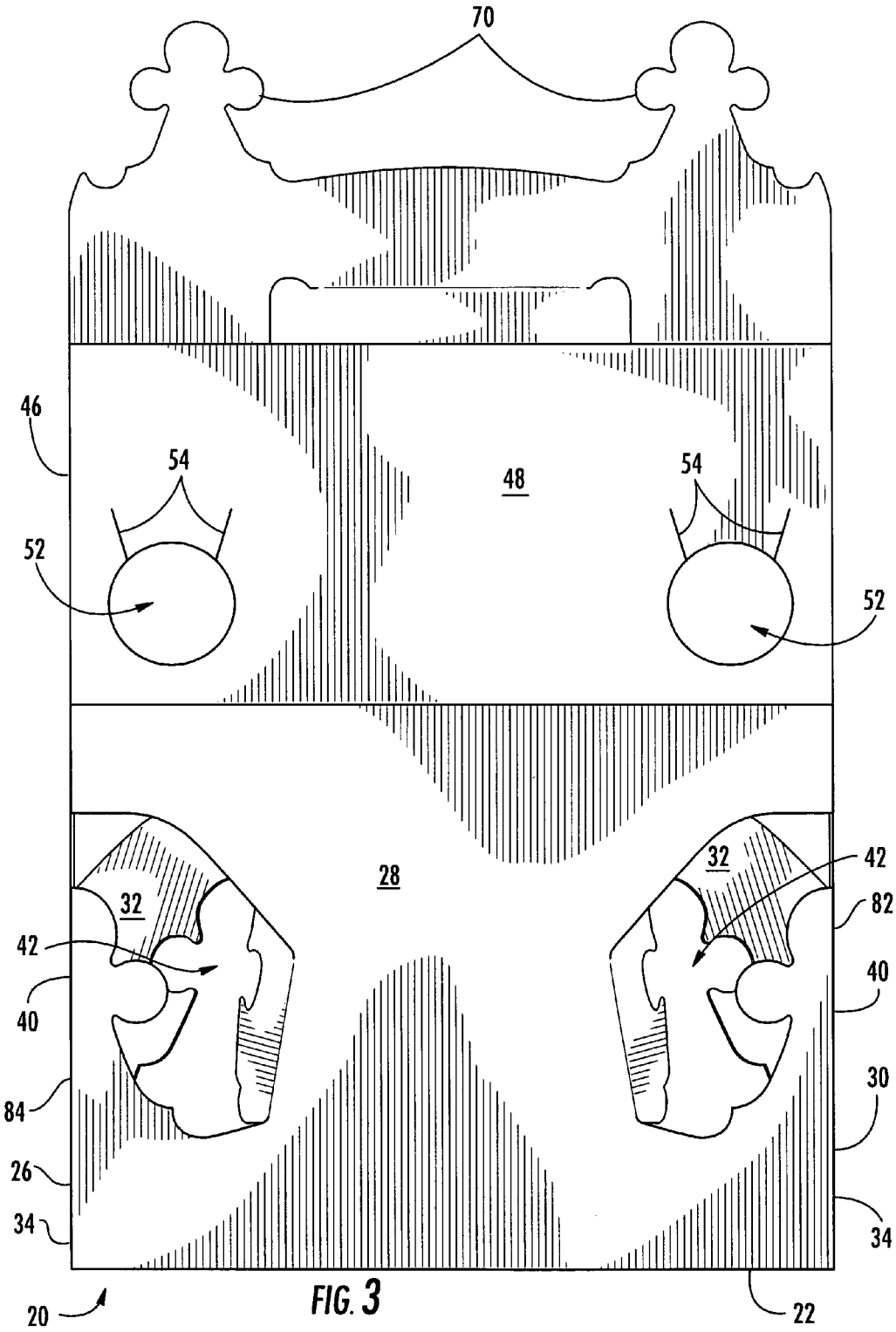
FIG. 3 is a rear elevation view of the carton with its top panels in the open configuration.
Figure 12:
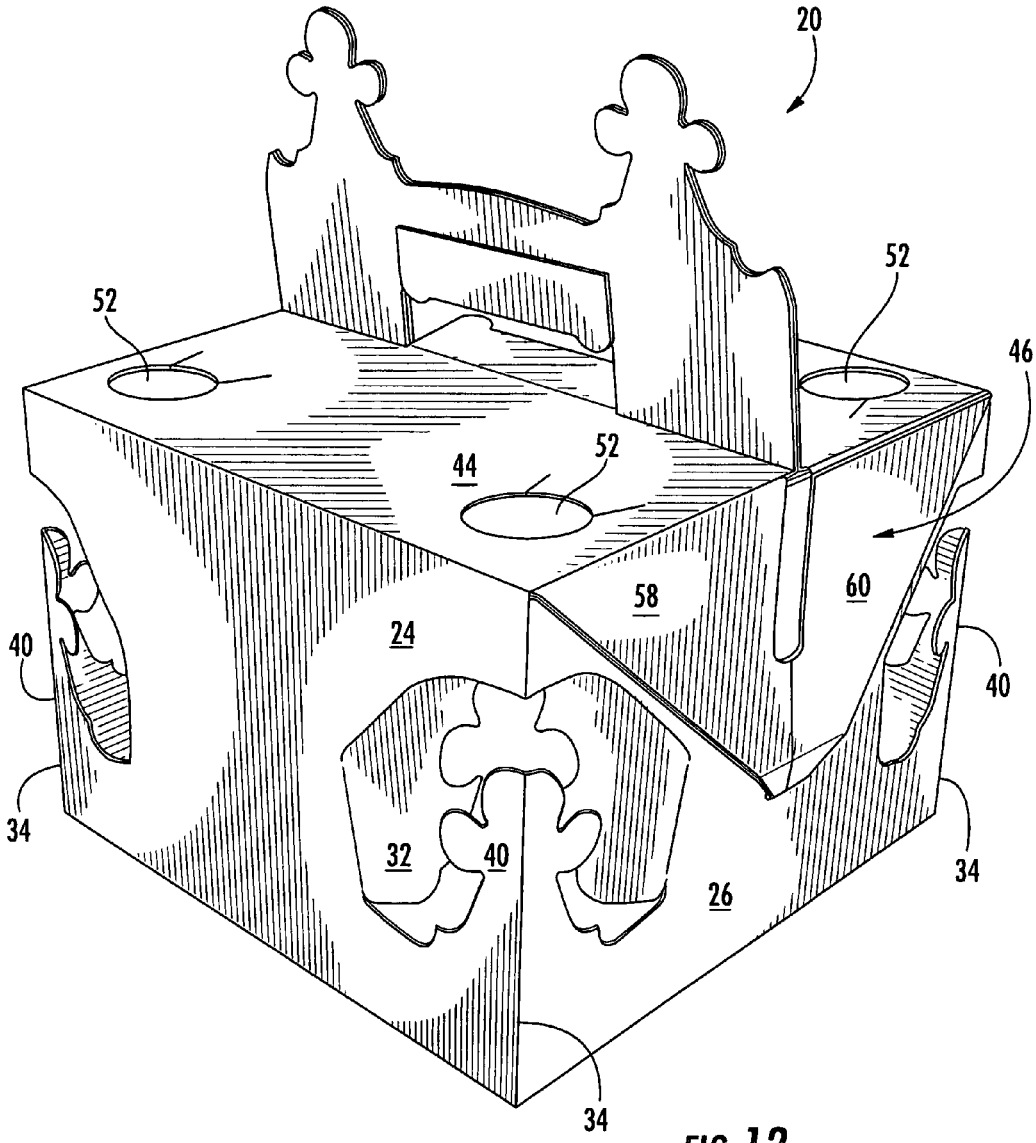
FIG. 12 is a front, right perspective view of the carton with its top panels in a flat closed configuration.
Figure 13:
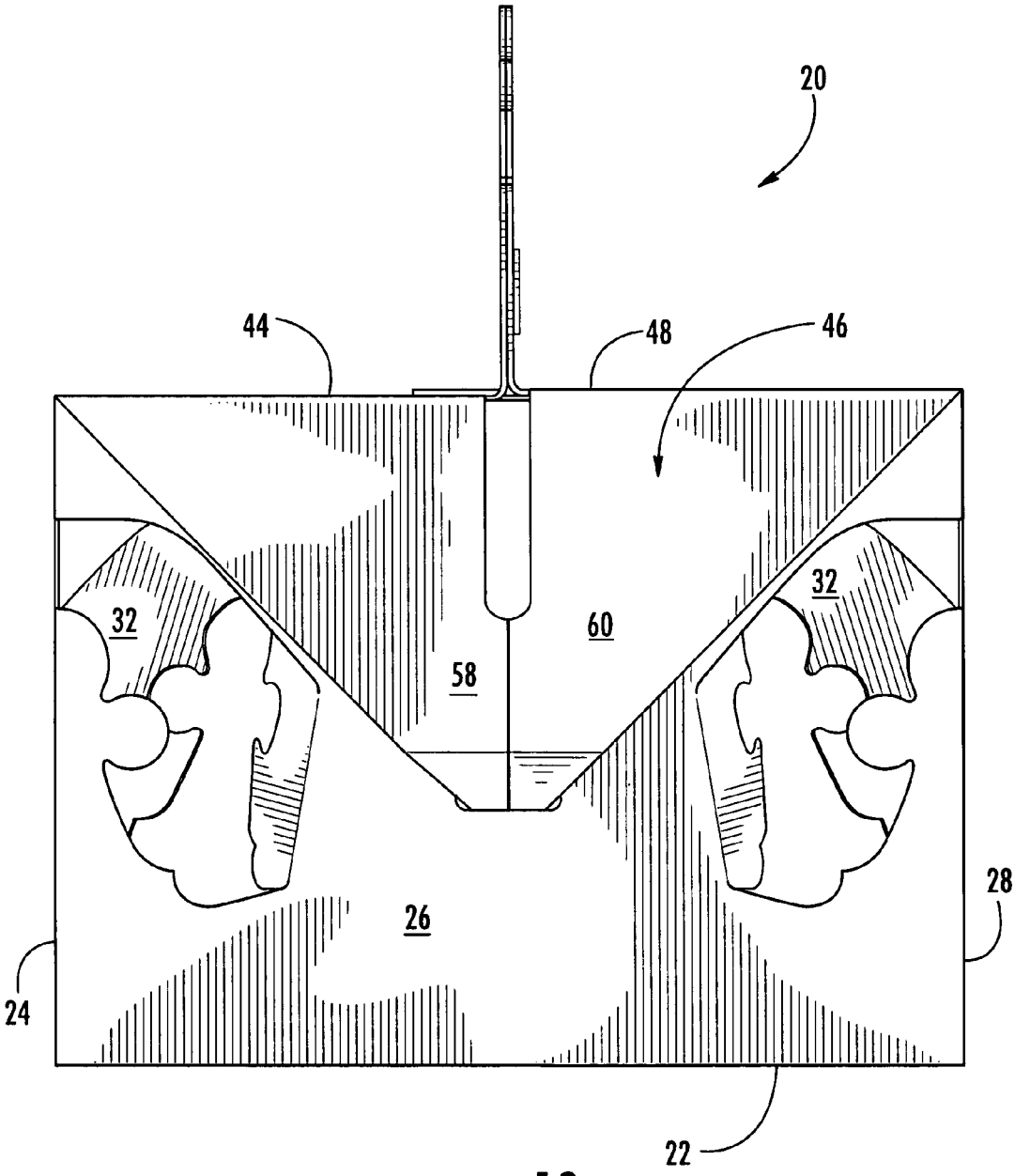
FIG. 13 is a right elevation view of the carton with its top panels in the flat closed configuration.
Figure 14:
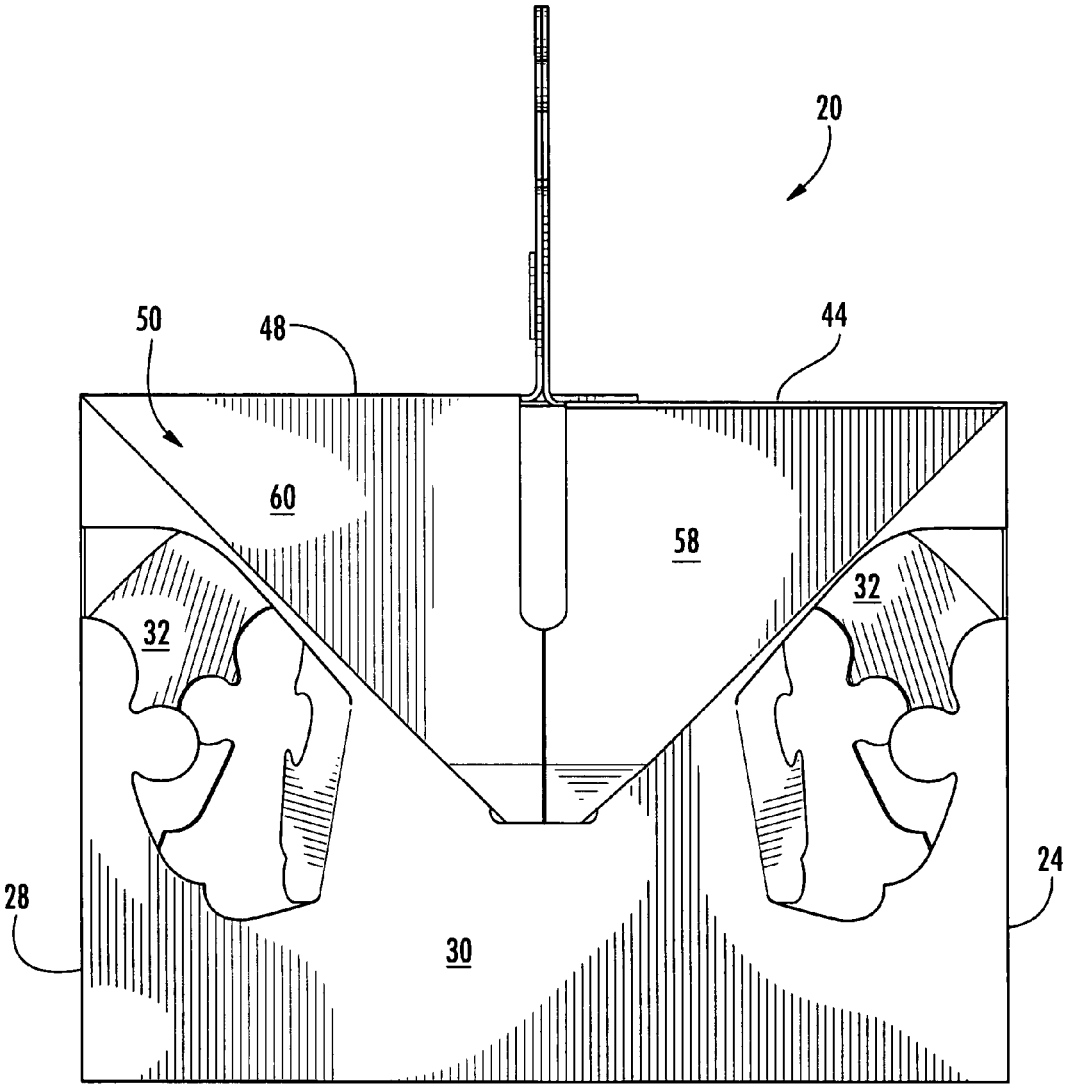
FIG. 14 is a left elevation view of the carton with its top panels in the flat closed configuration.

FIGS. 12-14 illustrate the top panels 44, 46, 48, 50 in a flat closed configuration. An acceptable method for converting the top panels 44, 46, 48, 50 from the open configuration illustrated in FIGS. 1-6 to the flat closed configuration illustrated in FIGS. 12-14 will be described in the following, in accordance with the exemplary embodiment of the present invention. For each of the right and left top panels 46, 50, the central triangular portion 56 is folded outward, so that the forward and rearward triangular portions 58, 60 also generally fold outwardly. At the same time, the front and rear top panels 44, 48 pivot inwardly. As a result, for each of the right and left top panels 46, 50, the forward and rearward triangular portions 58, 60 are in an opposing face-to-face configuration with, more specifically opposing face-to-face contact with, the central triangular portion 56. For each of the right and left top panels 46, 50, the converging points of the triangular portions 56, 58, 60 form a pointed fastening tab. As best understood with reference to FIGS. 4, 5 and 12-14, the pointed fastening tabs are respectively inserted into fastening slots formed by tearing along tear lines 72 (FIGS. 1, 3 and 4). By inserting the pointed fastening tabs into the fastening slots, the top panels 44, 46 48, 50 are releasably secured in the flat closed configuration.

Figure 15:
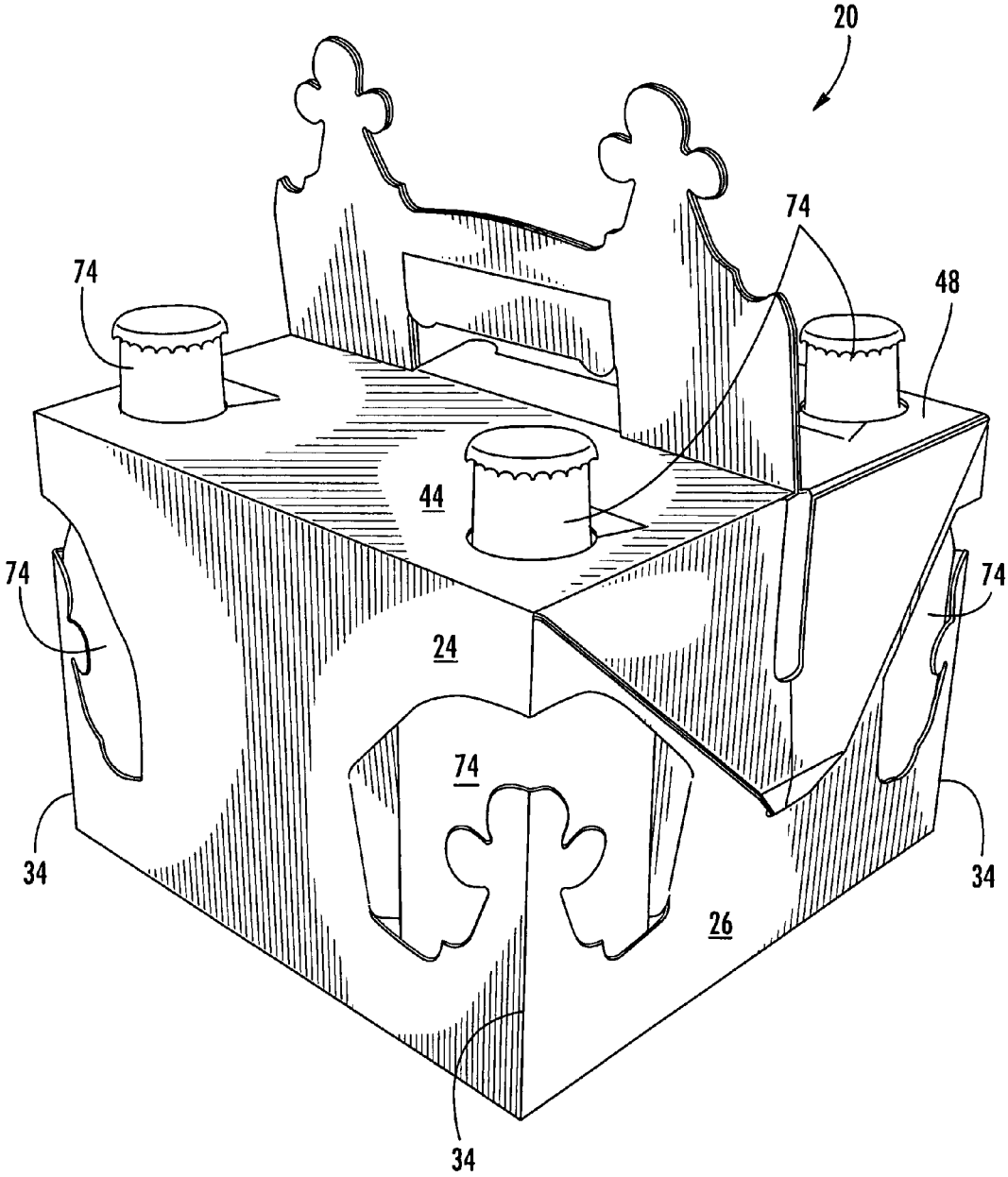

The carton 20 can be used for carrying a wide variety of articles. For example, FIG. 15 illustrates beverage containers, namely bottles 74, that are respectively within the corner compartments 36 and protruding out of the top holes 52. The top holes 52 are respectively positioned above, typically at least generally centered above, or more specifically centered above, the corner compartments 36. The tabs 40 can respectively engage the bottles 74, or more specifically cups or the like, to help secure them in place within the corner compartments 36. The bottles 74 can be replaced with cups, in which case the top holes 52 might be omitted. Other articles, such as sandwiches and side items, can be positioned between the corner compartments 36 within the carton's interior. The carrying of articles other than beverage containers, sandwiches and side items is also within the scope of the present invention.

Figure 16:
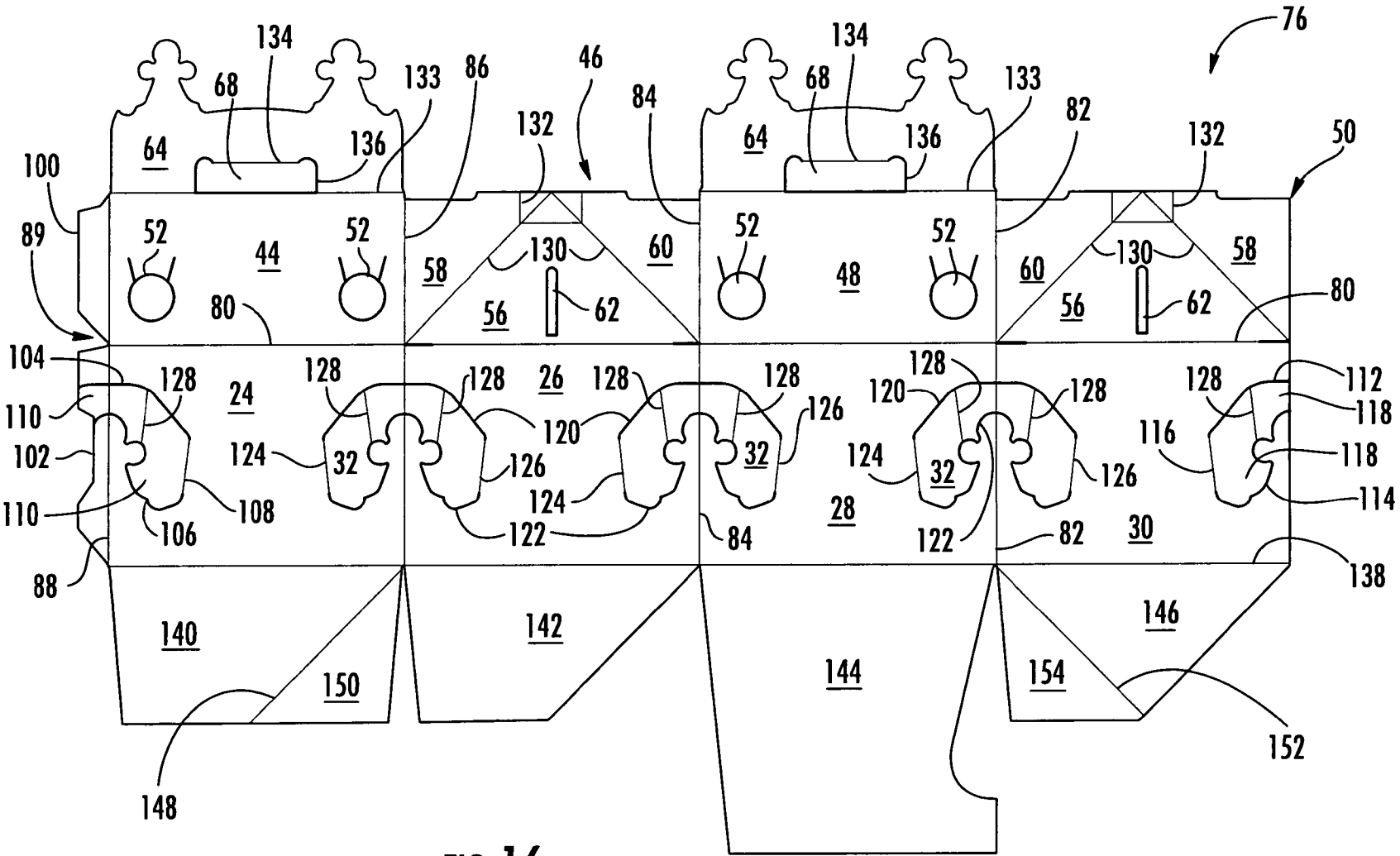
FIG. 16 is schematic plan view of a blank from which the carton can be erected, in accordance with the exemplary embodiment of the present invention.

FIG. 16 illustrates a blank 76 from which the carton 20 can be erected, in accordance with the exemplary embodiment of the present invention. Upper edges of the side panels 24, 26, 28, 30 are respectively foldably connected to the lower edges of the top panels 44, 46, 48, 50 along a longitudinal fold line 80 that extends between the opposite ends of the blank 76. The rear side panel 28 and the rear top panel 48 are respectively foldably connected to the left side panel 30 and the left top panel 50 along lateral fold line 82. The right side panel 26 and the right top panel 46 are respectively foldably connected to the rear side panel 28 and the rear top panel 48 along lateral fold line 84. The front side panel 24 and the front top panel 44 are respectively foldably connected to the right side panel 26 and the right top panel 46 along lateral fold line 86. An upper attachment flap 100 and a lower attachment flap 102 are respectively foldably connected to the front side panel 24 and the front top panel 44 along lateral fold line 88. A notch 89 is defined between the attachment flaps 100, 102.

One of the band-like partitions 32 of the erected carton 20 includes a partial partition 110 that is adhered to another partial partition 118. As best understood by reviewing the left end of the blank 76 illustrated in FIG. 16, upper tear lines 104, 106 extend from opposite ends of a fold line 108 to the left edge of the lower attachment flap 102 to define the partial partition 110. As best understood by referring to the right end of the blank 76 in FIG. 16, upper and lower tear lines 112, 114 extend from opposite ends of a fold line 116 to the right edge of the left side panel 30 to define the partial partition 118.

For each of the partitions 32 that are distant from the ends of the blank 76, the partition is defined by upper and lower tear lines 120, 122 extending between ends of end fold lines 124, 126. Optionally, each of the partitions 32 and partial partitions 110, 118 can further include intermediate fold lines 128 for enhancing the flexibility/foldability of the partitions 32.

Each of the right and left top panels 46, 50 includes the pair of diverging fold lines 130 for respectively defining the triangular portions 56, 58, 60. Each of the right and left top panels 46, 50 can further include what can be characterized as a generally U-shaped fold line 132 proximate the convergence of the pair of diverging fold lines 130. These U-shaped fold lines 132 can help to facilitate insertion of the overlapping ends of the triangular portions 56, 58, 60 into the respective slots defined by tearing along the tear lines 72 (FIGS. 1, 4 and 5) in the right and left side panels 26, 30. The tear lines 72 are omitted from FIG. 16 in an effort to clarify the view.

The handles 64 are respectively foldably connected to the front and rear top panels 44, 48 along longitudinal fold lines 133. Each of the handle flaps 68 is defined by a tear line 136 that extends between opposite ends of a longitudinal fold line 134.

The side panels 24, 26, 28, 30 are foldably connected along a longitudinal fold line 138 respectively to a front bottom panel 140, a right bottom panel 142, a rear bottom panel 144, and a left bottom panel 146. The longitudinal fold line 138 extends from one end of the blank 76 to the other end of the blank. An oblique fold line 148 foldably attaches an attachment flap 150 to the front bottom panel 140. Similarly, an oblique fold line 152 foldably attaches an attachment flap 154 to the left bottom panel 146.

Figure 17:
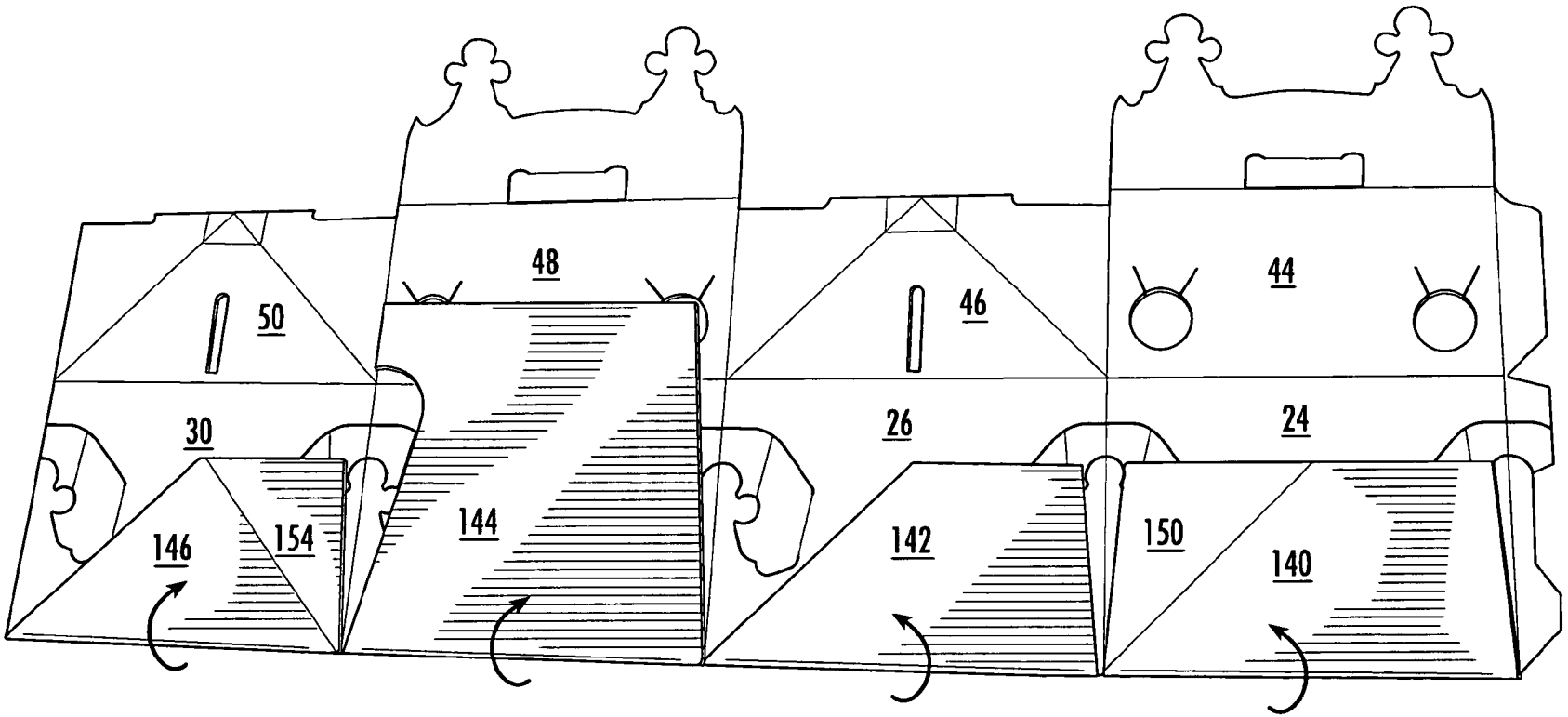
FIG. 17 schematically illustrates a step in erecting the carton from the blank, in accordance with the exemplary embodiment of the present invention.

An acceptable method for forming the carton 20 from the blank 76 will be described in the following, in accordance with the exemplary embodiment of the present invention. For ease of understanding, it is noted that either side of the blank 76 can be the exterior side of the carton 20, as exemplified by the fact that FIGS. 16 and 17 illustrate opposite sides of the blank. On the other hand, in some situations it will be desired for one side of the blank to have a superior finish as compared to the other side of the blank, in which case typically, but not necessarily, the more superior side of the blank 76 will correspond with the exterior side of the carton 20.

Figure 18:
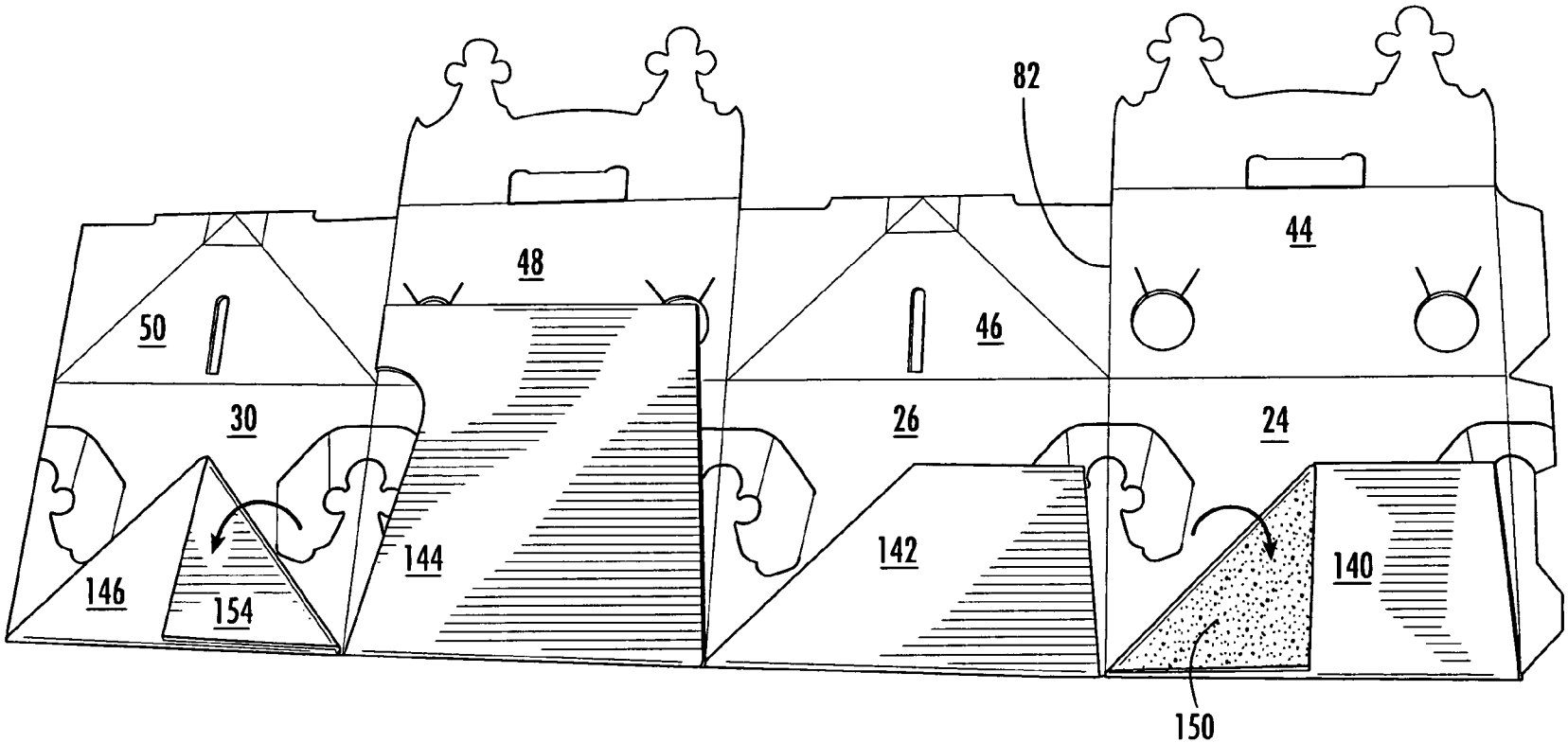
FIG. 18 schematically illustrates a step in erecting the carton from the blank, in accordance with the exemplary embodiment of the present invention.
Figure 19:
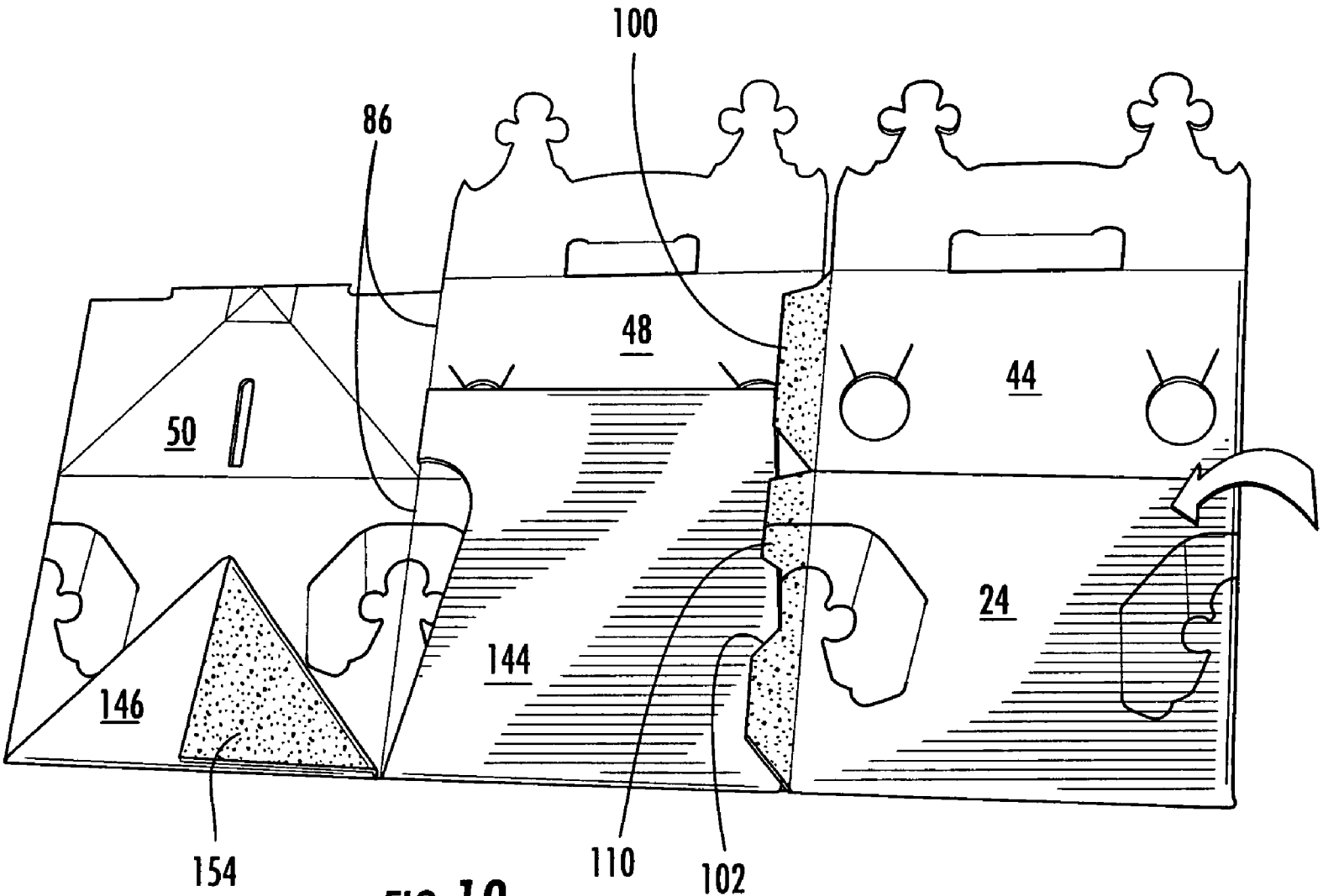
FIG. 19 schematically illustrates a step in erecting the carton from the blank, in accordance with the exemplary embodiment of the present invention.

Referring to FIGS. 16 and 17, each of the bottom panels 140, 142, 144, 146 is folded 180°, with the left bottom panel 146 carrying along the attachment flap 154 and the front bottom panel 140 carrying along the attachment flap 150. Referring to FIG. 18, each of the attachment flaps 150 and 154 is folded 180°. Thereafter, adhesive material, which is illustrated by stippling in FIG. 18, is applied to the attachment flap 150. Thereafter, folding occurs along the lateral fold line 82 to achieve the configuration illustrated in FIG. 19. As illustrated in FIG. 19, adhesive material, which is illustrated by stippling, is applied to each of the attachment flaps 100, 102, 154. Thereafter, folding takes place along lateral fold line 86 to achieve the configuration illustrated in FIG. 20.

Figure 20:
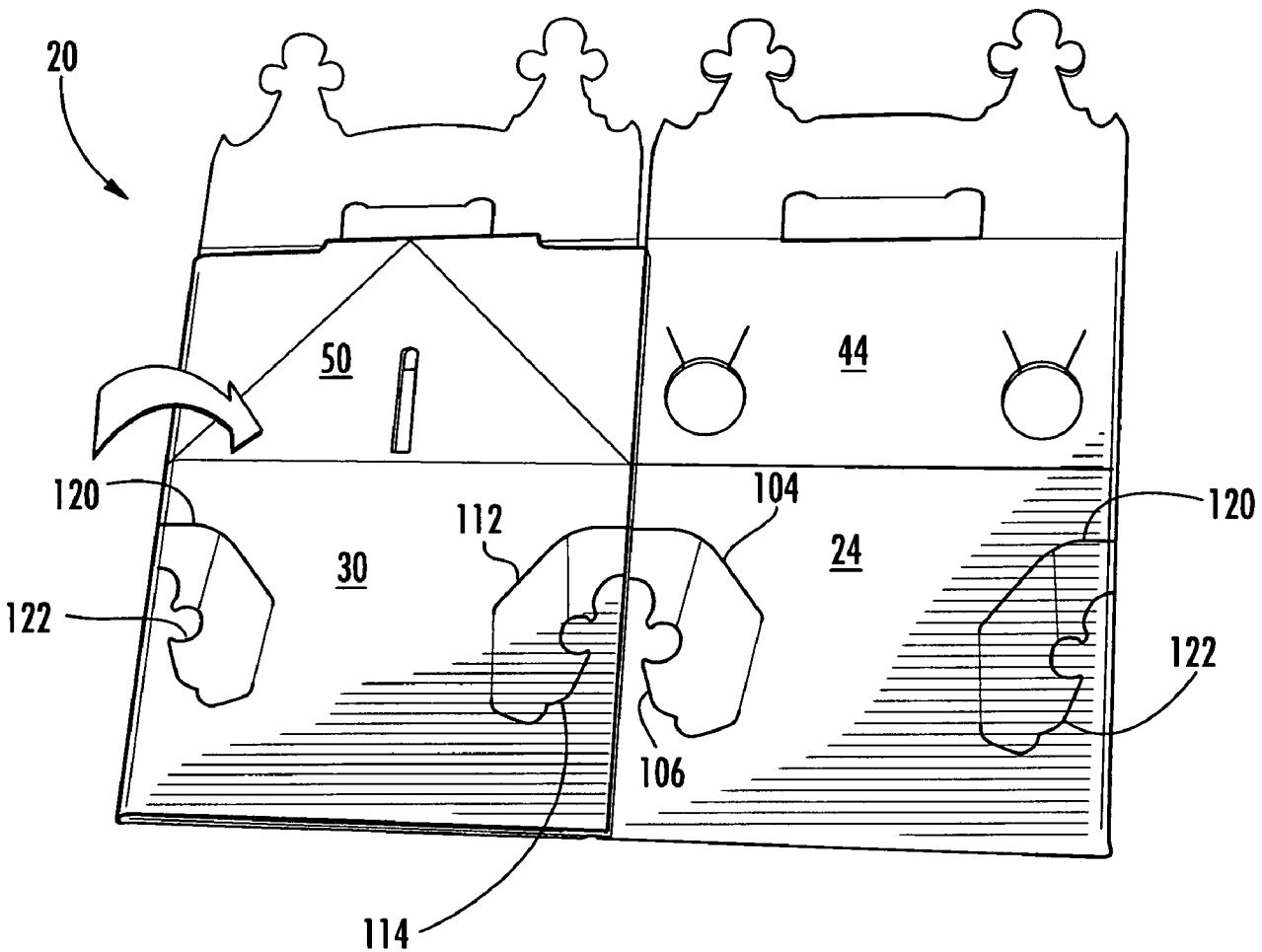
FIG. 20 schematically illustrates a step in erecting the carton from the blank, and it also illustrates the carton in its substantially flat, collapsed configuration, in accordance with the exemplary embodiment of the present invention.

With the blank 76 folded and in the configuration illustrated in FIG. 20 (and the adhesive material adhering as desired), the blank 76 can be characterized as being in the form of the carton 20 in its collapsed configuration. The carton 20 can be erected from its collapsed configuration by solely and simultaneously folding along all of the lateral fold lines 82, 84, 86, 88, so that the adhered blank 76/collapsed carton 20 becomes the erected carton 20 illustrated in FIG. 1. As a result of the configuration of the bottom panels 140, 142, 144, 146 and the attachment flaps 150, 154 being respectively adhered to the bottom panels 142, 144 as described above, the bottom 22 (FIG. 7) is automatically formed solely in response to the folding along the lateral folds lines 82, 84, 86, 88 that causes the adhered blank 76/collapsed carton 20 to open. Accordingly, the carton 20 includes an automatically formed bottom 22.

As should be apparent from FIG. 20, when the carton 20 is initially erected, typically none of the tear lines 104, 106, 112, 114, 120, 122 (FIG. 16) that define the band-like partitions 32 will be torn. Accordingly, after the carton 20 is initially erected, it is typical for each of the partitions 32 to be pushed inwardly toward the interior of the carton 20, so that tearing occurs along the tear lines 104, 106, 112, 114, 120, 122 to simultaneously form the partitions 32, tabs 40 and partition openings 42.

A wide variety of alternative embodiments are within the scope of the present invention. For example, one or more of, or even all of, the tear lines that form the tabs 40 and band-like partitions 32 can be omitted so that one or more of, or even all of, the upright corners 34 are relatively plain. As another example, the automatic bottom 22 can be replaced with any other type of bottom that is suitable for closing, or at least partially closing, the bottom of the carton 20.

In accordance with an alternative embodiment of the present invention, the carton 20 can be in the form of a tray, in that nothing is connected to the upper edges of the side panels 24, 26, 28, 30. In addition, whereas upper portions of the corners 34 are positioned above the exterior compartment openings 38 in accordance with the exemplary embodiment of the present invention, alternatively the exterior compartment openings 38 can extend all the way to the top edge of the tray-like carton 20 such that there are no corners 34 above the exterior compartment openings 38.

In accordance with the exemplary embodiment of the present invention, a fold line can be any at least somewhat line-like arranged, although not necessarily straight, form of weakening that facilitates folding therealong; and a tear line can be any at least somewhat line-like arranged, although not necessarily straight, form of weakening that facilitates tearing therealong. More specifically, but not for the purpose of narrowing the scope of the present invention, conventional fold lines include: a crease, such as formed by folding; a score line, such as formed with a blunt scoring knife, or the like, which creates a crushed portion in the material along the desired line of weakness; a slit that extends partially into the material along the desired line of weakness, and/or a series of spaced apart slits that extend partially into and/or completely through the material along the desired line of weakness; or various combinations of these features. More specifically, but not for the purpose of narrowing the scope of the present invention, conventional tear lines include: a slit that extends partially into the material along the desired line of weakness, and/or a series of spaced apart slits that extend partially into and/or completely through the material along the desired line of weakness, or various combinations of these features.

As a more specific example, one type of conventional tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present invention for each of the tear lines to be replaced with a continuous slit, or the like.

In situations where cutting is used to provide a fold line, typically the cutting will not be overly extensive in a manner that might cause a reasonable user to incorrectly consider the fold line to be a tear line. In contrast, where nicks are present in a tear line, typically the nicks will not be overly large or overly numerous in a manner that might cause a reasonable user to incorrectly consider the subject line to be a fold line.

In accordance with the exemplary embodiment of the present invention, the blank is constructed of paperboard, or the like, and the paperboard can optionally have one or more other materials coated or laminated thereon. For example, paperboard typically weighs at least about 100 pounds per ream, with each sheet of paperboard typically being at least about 0.012 inches thick, so that it is heavier and more rigid than ordinary paper. The blank can also be constructed of other material, such as cardboard, or any other material having properties suitable for enabling the cartons to function at least generally as described above.

For example, one or both sides of the blank can be coated with a clay coating, or the like. The clay coating can be printed over with product, advertising, and other information or images. The blanks may then be coated with a varnish or other protective coating to protect any information printed on the blank. The blanks may also be coated with, for example, a moisture barrier layer, on either or both sides of the blanks. Other coating and laminating upon the blanks is also within the scope of the present invention.

The directional references, for example "top", "front", "left end" and "longitudinal", referred to in this Detailed Description section are used for ease of understanding rather than for the purpose of narrowing the scope of the present invention.

It will be understood by those skilled in the art that while the present invention has been discussed above with reference to exemplary embodiments, various additions, modifications and changes can be made thereto without departing from the spirit and scope of the invention as set forth in the following claims.

What is claimed is:

1. A carton capable of holding a plurality of articles, the carton comprising:

a bottom;

a plurality of side panels extending upwardly from respective edges of the bottom, wherein upright edges of the plurality of side panels are respectively connected to one another to define a plurality of upright corners of the carton;

at least a first opening to the carton's interior, wherein the first opening extends across an upright corner of the plurality of upright corners and through the side panels that define the upright corner; and at least one partition having opposite ends that are respectively pivotably connected at first and second fold lines to the side panels that define the upright corner, so that the partition can be pivoted between a deployed configuration and an undeployed configuration, wherein the partition at least partially closes the first opening in the undeployed configuration, and the partition extends into the carton's interior and at least partially around a compartment in the carton's interior during the deployed configuration, whereby the partition at least partially defines the compartment during the deployed configuration, and wherein the first and second fold lines extend obliquely with respect to the upright corner, all of the first fold line is spaced apart from the upright corner, and all of the second fold line is spaced apart from the upright corner.

2. The carton according to claim 1, wherein the partition is formed from the side panels that define the upright corner.

3. The carton according to claim 1, wherein the compartment is for holding at least one of the plurality of articles.

4. The carton according to claim 1, wherein during the undeployed configuration, the partition is at least substantially flush with the side panels that define the upright corner.

5. The carton according to claim 1, wherein the bottom includes a plurality of panels that are operative for automatically forming the bottom in response to predetermined folding of the plurality of side panels.

6. The carton according to claim 1, wherein:

upper edges respectively of the plurality of side panels extend around and define an upper opening to the carton's interior, the carton further comprises a cover for at least partially closing the upper opening, the cover defines at least one opening, and the opening that is defined by the cover is positioned at least partially aligned with the compartment while the cover is at least partially closing the upper opening during the deployed configuration.

7. The carton according to claim 1, wherein:

the first opening divides the upright corner into an upper corner section and a lower corner section, and the upper corner section is positioned above the first opening.

8. The carton according to claim 1, wherein:

upper edges respectively of the plurality of side panels extend around and define an upper opening to the carton's interior, and the carton further comprises a cover for at least partially closing the upper opening, with the cover including at least one handle, and at least one pair of tabs extending upwardly from the handle, wherein the tabs are spaced apart from one another.

9. The carton according to claim 8, wherein each of the tabs is symbol-shaped.

10. The carton according to claim 8, wherein each of the tabs includes a plurality of lobes.

11. The carton according to claim 1, wherein:

upper edges respectively of the plurality of side panels extend around and define an upper opening to the carton's interior;

the carton further comprises a plurality of top panels that are respectively pivotably connected to upper edges of the plurality of side panels, and operative for providing opened and closed configurations;

the upper opening is at least partially closed by the plurality of top panels during the closed configuration; and at least some of the plurality of top panels are farther away from the upper opening in the opened configuration than in the closed configuration, so that the upper opening to the carton's interior is at least partially open during the opened configuration.

12. The carton according to claim 11, wherein:

the plurality of top panels includes at least one top panel that includes at least one fold line for defining at least first and second sections of the top panel; and at least the first and second sections are in an overlapping relationship with respect to one another during the closed configuration.

13. The carton according to claim 12, wherein the overlapping first and second sections further overlap a side panel of the plurality of side panels during the closed configuration.

14. The carton according to claim 13, wherein the overlapping first and second sections at least partially define a fastening tab that is releasably fastened to the side panel during the closed configuration.

15. The carton according to claim 12, wherein the plurality of top panels is operative for defining opposite gable areas in the closed configuration.

16. The carton according to claim 12, wherein:

the closed configuration is a first closed configuration in which the plurality of top panels is operative for defining opposite gable areas;

the plurality of top panels is further operative for providing a second closed configuration in which the upper opening is at least partially closed by the plurality of top panels;

the first section overlaps the second section in the first closed configuration; and the second section overlaps the first section in the second closed configuration.

17. The carton according to claim 16, wherein the plurality of top panels is operative for defining an at least substantially flat cover in the second closed configuration.

18. The carton according to claim 11, wherein:

the plurality of side panels includes a first side panel, a second side panel, a third side panel and a fourth side panel;

the plurality of top panels includes a first top panel foldably connected to an upper edge of the first side panel, a second top panel foldably connected to an upper edge of the second side panel, a third top panel foldably connected to an upper edge of the third side panel, and a fourth top panel foldably connected to an upper edge of the second side panel;

adjacent edges of the first and second top panels are foldably connected to one another;

adjacent edges of the second and third top panels are foldably connected to one another;

adjacent edges of the third and fourth top panels are foldably connected to one another;

adjacent edges of the fourth and first top panels are foldably connected to one another;

the second top panel includes at least a first section, a second section and a third section;

the second section is between the first and third sections at least during the open configuration;

there is an overlapping relationship between the first and second sections during the closed configuration; and there is an overlapping relationship between the second and third sections during the closed configuration.

19. The carton according to claim 1, further comprising a second opening that extends both through the partition and all the way to a bottom edge of the partition, wherein:

the second opening includes opposite upper and lower ends, each of the first and second fold lines includes opposite upper and lower ends, and as compared to the lower ends of the first and second fold lines, the upper end of the second opening is farther away from the bottom of the carton.

20. The carton according to claim 1, further comprising a second opening that extends both through the partition and all the way to a bottom edge of the partition, wherein:

the second opening includes opposite upper and lower ends, each of the first and second fold lines includes opposite upper and lower ends, and as compared to the upper ends of the first and second fold lines, the upper end of the second opening is farther away from the bottom of the carton.

21. The carton according to claim 1, further comprising a second opening that extends through the partition, wherein:

the second opening includes opposite upper and lower ends, and a length that extends between the opposite upper and lower ends, for each fold line of the first and second fold lines, the fold line includes opposite upper and lower ends, and a length that extends between the opposite upper and lower ends of the fold line, and for each fold line of the first and second fold lines, the length of the fold line is smaller than the length of the second opening.

22. The carton according to claim 1, further comprising a second opening that extends both through the partition and all the way to a bottom edge of the partition, wherein:

the second opening includes opposite upper and lower ends, each of the first and second fold lines includes opposite upper and lower ends, and as compared to the lower ends of the first and second fold lines, the lower end of the second opening is closer to the bottom of the carton.

23. The carton according to claim 22, wherein, as compared to the upper ends of the first and second fold lines, the upper end of the second opening is farther away from the bottom of the carton.

24. The carton according to claim 1, wherein the partition includes:

a third fold line positioned between, and spaced apart from, the first and second fold lines, wherein the first and second fold lines extend obliquely with respect to the third fold line; and a fourth fold line positioned between, and spaced apart from, the second and third fold lines, wherein the fourth fold line extends obliquely with respect to both the upright corner and the third fold line.

25. The carton according to claim 1, comprising a second opening that extends through the partition.

26. The carton according to claim 25, wherein the second opening is symbol-shaped.

27. The carton according to claim 25, wherein the second opening includes a plurality of lobes.

28. The carton according to claim 25, further comprising at least one tab that at least partially defines the first opening, wherein:

first opening extends at least partially around the tab, and the tab at least partially closes the second opening during the undeployed configuration.

29. The carton according to claim 28, wherein:

the first opening divides the upright corner into an upper corner section and a lower corner section, the upper corner section is positioned above the first opening, and the tab extends upwardly from the lower corner section.

30. The carton according to claim 28, wherein the tab is part of the side panels that define the upright corner.

31. The carton according to claim 28, wherein the tab at least generally corresponds in shape to the second opening.

32. The carton according to claim 28, wherein the tab is symbol-shaped.

33. The carton according to claim 28, wherein the tab includes a plurality of lobes.

34. The carton according to claim 28, wherein the tab includes an upright base and three lobes protruding from an upper end of the base, with two of the lobes respectively protruding outwardly from opposite sides of the base, and another of the lobes protruding upwardly from the base.

35. The carton according to claim 34, wherein the tab at least generally corresponds in shape to the second opening.

36. A carton comprising:

a bottom;

a plurality of side panels extending upwardly from respective edges of the bottom, wherein upright edges of the plurality of side panels are respectively connected to one another to define a plurality of upright corners of the carton, wherein at least one upright corner of the plurality of upright corners includes at least one tab that protrudes upwardly, away from the bottom of the carton; and at least one band that extends across the upright corner and at least partially around the tab, wherein the band has opposite ends that are respectively pivotably connected at first and second fold lines to the side panels that define the upright corner, each of the first and second fold lines includes opposite upper and lower ends, the tab includes opposite upper and lower ends, as compared to the lower ends of the first and second fold lines, the upper end of the tab is farther away from the bottom of the carton, and the band is adapted for being pushed inwardly so that the band extends into the carton's interior and at least partially around a compartment in the carton's interior, and so that each of the first and second fold lines is substantially located at a periphery of the carton's interior while the band extends into the carton's interior and at least partially around the compartment in the carton's interior.

37. The carton according to claim 36, wherein:

the band divides the upright corner into an upper corner section and a lower corner section, the upper corner section is positioned above the band, and the tab extends upwardly from the lower corner section.

38. The carton according to claim 36, wherein the tab is symbol-shaped.

39. The carton according to claim 36, wherein the tab includes a plurality of lobes.

40. The carton according to claim 36, further comprising at least one fold line that extends along the upright corner, wherein the fold line divides the tab.

41. The carton according to claim 40, wherein the fold line bisects the tab.

42. The carton according to claim 36, further comprising a plurality of lines that define the tab and the band in the side panels that define the upright corner.

43. The carton according to claim 42, wherein the plurality of lines includes at least one tear line.

44. The carton according to claim 43, wherein the tear line includes one or more nicks.

45. The carton according to claim 36, wherein, as compared to the upper ends of the first and second fold lines, the upper end of the tab is farther away from the bottom of the carton.

46. The carton according to claim 36, wherein, as compared to the lower ends of the first and second fold lines, the lower end of the tab is closer to the bottom of the carton.

47. The carton according to claim 36, wherein:

the tab has a length that extends between the opposite upper and lower ends of the tab, for each fold line of the first and second fold lines, the fold line has a length that extends between the opposite upper and lower ends of the fold line, and for each fold line of the first and second fold lines, the length of the fold line is smaller than the length of the tab.

48. The carton according to claim 36, wherein the band includes:

a third fold line positioned between, and spaced apart from, the first and second fold lines; and a fourth fold line positioned between, and spaced apart from, the second and third fold lines.

49. A blank for being erected into a carton, the blank comprising:

a plurality of side panels;

a plurality of fold lines by which edges of the plurality of side panels are respectively connected to one another;

at least one band that extends across a first fold line of the plurality of fold lines, wherein the band has opposite ends that are respectively pivotably connected at second and third fold lines to the side panels that are connected by the first fold line, the second and third fold lines extend obliquely with respect to the first fold line, all of the second fold line is spaced apart from the first fold line, and all of the third fold line is spaced apart from the first fold line; and a tab, wherein the tab extends along the first fold line such that a portion of the first fold line is formed in the tab, the band extends at least partially around the tab, the tab has a length that extends between opposite ends of the tab, each of the second and third fold lines has a length that extends between opposite ends of the second and third fold line, and the length of each of the second and third fold lines is smaller than the length of the tab.

50. The blank according to claim 49, wherein the tab is symbol-shaped.

51. The blank according to claim 49, wherein the tab includes a plurality of lobes.

52. The blank according to claim 49, further comprising a plurality of lines that define the tab and the band in the side panels that are connected by the fold line.

53. The blank according to claim 52, wherein the plurality of lines includes at least one tear line.

54. The blank according to claim 49, wherein the first fold line divides the tab.

55. The blank according to claim 49, wherein the band includes a fourth fold line positioned between, and spaced apart from, the first and second fold lines, wherein the fourth fold line extends obliquely with respect to the first fold line.

56. A blank for being erected into a carton, the blank comprising:

a plurality of side panels;

a plurality of fold lines by which edges of the plurality of side panels are respectively connected to one another;

at least one band that extends across a first fold line of the plurality of fold lines; and a plurality of lines that define a tab and the band in the side panels that are connected by the first fold line, wherein the plurality of lines includes at least one tear line, the band has opposite ends that are respectively pivotably connected at second and third fold lines to the side panels that are connected by the first fold line, the second and third fold lines extend obliquely with respect to the first fold line, all of the second fold line is spaced apart from the first fold line, and all of the third fold line is spaced apart from the first fold line.

57. A blank for being erected into a carton, the blank comprising:

a plurality of side panels that are respectively connected to one another;

a fold line; and a top panel foldably connected by way of the fold line to at least one of the side panels, wherein the top panel includes a handle with a handle opening and a gripping region adjacent to the handle opening, wherein the gripping region includes opposite first and second ends, a first tab proximate the first end of the gripping region, wherein the first tab projects away from the handle opening, and a second tab proximate the second end of the gripping region, wherein the second tab projects away from the handle opening, the second tab is spaced apart from the first tab so that a gap is defined between the first and second tabs, the gap and the handle opening are positioned on opposite sides of the gripping region so that the gap extends in a first direction away from a first of the opposite sides of the gripping region, and the handle opening extends in a second direction away from a second of the opposite sides of the gripping region, the first and second directions are opposite from one another, the first and second directions are perpendicular to the fold line, a maximal distance that the first tab extends in the first direction away from the fold line is substantially greater than a maximal distance that the gripping region extends in the first direction away from the fold line, and a maximal distance that the second tab extends in the first direction away from the fold line is substantially greater than the maximal distance that the gripping region extends in the first direction away from the fold line, so that, as compared to the gripping region, the first and second tabs are farther away from the fold line than any other portion of the top panel.

58. The blank according to claim 57, further comprising a handle flap positioned in the handle opening

59. A carton erected from the blank of claim 57, wherein:

the top panel at least partially closes an opening to the carton;

each of the gripping region and the first and second tabs extend upwardly; and the first and second tabs extend substantially farther upwardly than the gripping region.

60. The blank according to claim 57, wherein:

the top panel is a first top panel, the handle is a first handle, the handle opening is a first handle opening, and the gripping region is a first gripping region;

the blank further comprises a second top panel foldably connected to at least one of the side panels; and the second top panel includes a second handle with a second handle opening and a second gripping region adjacent to the second handle opening, wherein the second gripping region includes opposite first and second ends, a third tab proximate the first end of the second gripping region, wherein the third tab projects away from the second handle opening, and a fourth tab proximate the second end of the second gripping region, wherein the fourth tab projects away from the second handle opening, and the fourth tab is spaced apart from the third tab so that a second gap is defined between the third and fourth tabs, the second gap and the second handle opening are positioned on opposite sides of the of the second gripping region so that the second gap extends in the first direction away from a first of the opposite sides of the second gripping region, and the second handle opening extends in the second direction away from a second of the opposite sides of the second gripping region, and as compared to the second gripping region, the third and fourth tabs extend substantially farther away from the plurality of side panels in the first direction.

61. A carton erected from the blank of claim 60, wherein:

the first and second top panels at least partially close an opening to the carton;

the first handle opening is aligned with the second handle opening;

the first gripping region is aligned with the second gripping region;

the first tab is aligned with the third tab;

the second tab is aligned with the fourth tab; and the first, second, third and fourth tabs extend upwardly.

62. The carton according to claim 61, wherein:

the first and third tabs are in opposing face-to-face contact with one another; and the second and fourth tabs are in opposing face-to-face contact with one another.

63. The blank according to claim 57, wherein each of the first and second tabs is immediately adjacent to the gripping region.

* * * * *